United States Patent [19]

Henry et al.

[11] 4,147,235

[45] Apr. 3, 1979

[54] ELEVATOR CONTROL SYSTEM

[75] Inventors: Thomas Henry, Floral Park; Jean Youla, Brooklyn, both of N.Y.

[73] Assignee: Otis Elevator Company, New York, N.Y.

[21] Appl. No.: 812,203

[22] Filed: Jul. 1, 1977

[51] Int. Cl.[2] ..... B66B 1/18

[52] U.S. Cl. ..... 187/29 R

[58] Field of Search ..... 187/29

[56] References Cited

U.S. PATENT DOCUMENTS 3,236,332 2/1966 Burgy et al. ..... 187/29

*Primary Examiner*—Robert K. Schaefer
*Assistant Examiner*—W. E. Duncanson, Jr.
*Attorney, Agent, or Firm*—Robert T. Mayer

[57] ABSTRACT

Apparatus including auxiliary hall call registration means and selection means which cooperate with an elevator control system operating a plurality of cars in a predetermined manner in response to primary hall calls and car calls registered for a plurality of landings to select a car signified as closest to a landing for which an auxiliary hall call is registered and to cause the control system to operate the selected car in a manner in which it travels to and stops at the landing for which the auxiliary hall call is registered.

3 Claims, 13 Drawing Figures

RSH1(a)[6]
RSH1(b)
RSH1(c)
RSH1(d)
RSH1
SH1[1]
NA7
SHA1[3]
NA21
IA1
SHA3
SHA4
RSH2(a)[6]
RSH2(b)
RSH2(c)
RSH2(d)
RSH2
SH2[1]
NA9
SHA2[3]
RSH6(a)[6]
RSH6(b)
RSH6(c)
RSH6(d)
RSH6
SH6[1]
NA11
SHA6[3]
SHA5
NA23
IA3
SHA8
RSH7(a)[6]
RSH7(b)
RSH7(c)
RSH7(d)
RSH7
SH7[1]
NA13
SHA7[3]
RSH11(a)[6]
RSH11(b)
RSH11(c)
RSH11(d)
RSH11
SH11[1]
NA15
SHA11[3]
SHA9
SHA10
NA25
IA5
RSH12(a)[6]
RSH12(b)
RSH12(c)
RSH12(d)
RSH12
SH12[1]
NA17
SHA12[3]
SHA13
SHA14
NA27
IA7
SHA15
RSHT(a)[6]
RSHT(b)
RSHT(c)
RSHT(d)
RSHT
SHT[1]
NA19
SHAT[3]
IA9
TD1
IA11
EWLD[6]
NA29
GPEC(a)[9]
GPEC(b)
GPEC(c)
GPEC(d)
GPEC
IA13

UHA0[5]
UHA1[5]
UHA2[5]
UHA4[5]
UHA8[5]
U32(i)
BC4
BC3
BC6
BC5
BC2
BC1
DS2
DS1
MM1
MM2
100KC
CPG
X0[7]
X1[7]
X2[7]
X3[7]
X4[7]
HL1
DHA8[5]
DHA4[5]
DHA2[5]
DHA1[5]
DHA0[5]
D32(i)
LD(i)
CLR(i)
AN2
AN4
AN6
AN8
AN10
AN12
AN14
AN17
NA35
NA37
NA33
NA31
IA15
IA16
IA18
U32
D32
U32(i)
D32(i)
SS[4]
SC[4]
SHAT[2]
SHAT12[2]
SHAT11[2]
SHAT7[2]
SHAT6[2]
SHAT2[2]
SHAT1[2]
A
B
C
D
S
L10

ELEVATOR CONTROL SYSTEM

This invention relates to elevator control systems. More particularly it concerns an improved elevator control system with both primary and auxiliary hall call registering means. The system selects that one of a plurality of cars which is the closest distance from a landing for which an auxiliary hall call is registered and causes the selected car to travel to and to stop at that landing while ignoring primary hall calls. In this way, expedited service is provided those people registering auxiliary hall calls.

One plural car control system (Burgy et al U.S. Pat. No. 3,236,332) is known to employ primary and auxiliary hall call registration devices and to use the auxiliary devices to expedite service to landings by selecting the closest approaching car in the group or a stopped car for response to an auxiliary hall call registered at the lowermost landing. This car is then rendered inoperable of further response to its car calls or to primary hall calls while traveling downwardly. As a result, it is made available to the one who registered the auxiliary hall call at the lowermost landing sooner than might otherwise occur.

Since no provision is made for selecting that one of the cars which is expected to be the first to encounter this landing, long delays may occur between the registration of an auxiliary hall call at an intermediate landing and the arrival of a car at that landing.

It is an object of the invention to provide an improved elevator control system for expediting service to landings for which auxiliary hall calls are registered.

Another object of the invention is to select in response to an auxiliary hall call one of a plurality of cars operating as a supervised group in response to primary hall calls and car calls and to cause the selected car to travel to and to stop at the landing for which the auxiliary hall call is registered while preventing it from responding to primary hall calls and its car calls regardless of its original direction of travel.

A further object of the invention is to select that one of a group of cars which is the closest distance from a landing for which an auxiliary hall call is registered and to cause the selected car to travel to and to stop at the landing in an expedited manner in response to the registered auxiliary hall call.

A still further object of the invention is to cause the first car of a group to arrive at a landing for which an auxiliary hall call is registered whether selected or not, to stop at the landing in response to the registered hall call signal and to open its doors.

In accordance with the invention there is provided an improved elevator control system having a plurality of cars serving upper, lower and a plurality of intermediate landings of a building. The elevator control system includes primary hall call registration means associated with each of the landings and each operable to register a primary hall call. The control system also includes car call registration means, car position signifying means and control equipment individually associated with each of the cars and operable to produce car call signals for the landings and car position signals signifying the position of each car. The control system functions to cause the cars to operate in a predetermined manner in response to the primary hall calls and the car calls associated with each car. In addition to the above there is also provided auxiliary hall call registration means separately associated with any one of the landings of the building and selection means operable in response to a registered auxiliary hall call produced by one of the auxiliary hall call registration means when all of said cars are signified as being located at landings other than that for which said auxiliary hall call is registered to select a car for expedited service to the landing associated with the registered auxiliary hall call. The control equipment operates in response to the selection means to cause the selected car to travel to and to stop at the landing associated with the registered auxiliary hall call signal.

Other objects, features and advantages of the invention will be apparent to those skilled in the art from the following description and appended claims when considered in conjunction with the accompanying drawing in which:

Figure 1:
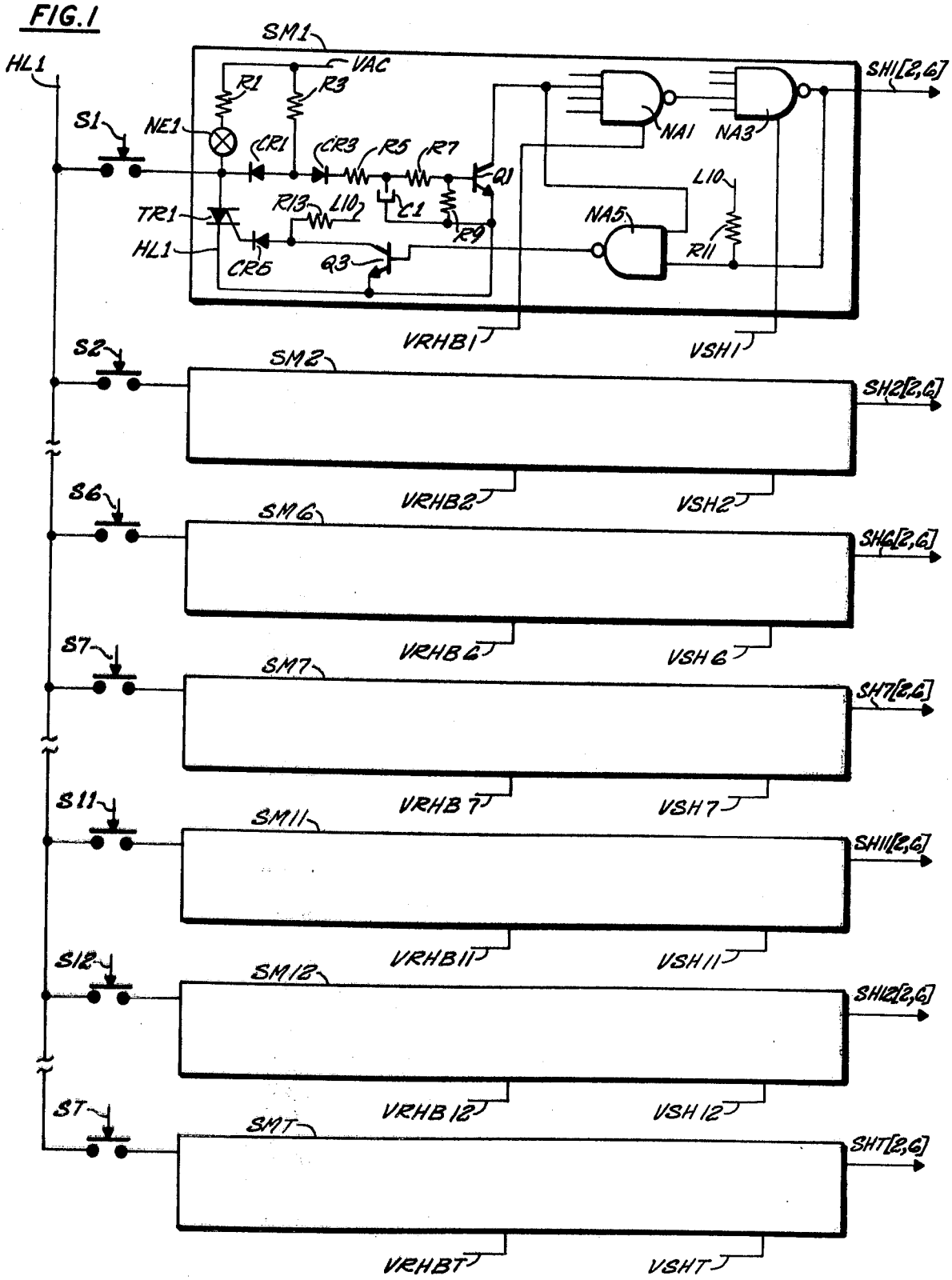
FIG. 1 is a simplified schematic diagram of the auxiliary hall call registering devices and the associated interface circuitry for a plurality of landings.

The invention is disclosed in an elevator installation having four cars which are operated as members of a supervised group and in which the building is divided into zones or groups of landings. In accordance with this well known arrangement each car primarily responds to first hall call signals registered for landings in a zone according to the location of the car with respect to the zone and the location of the remaining cars of the group. A control system of this type entitled "Solid State Control System" for which the invention is particularly suited is described in U.S. Pat. No. 3,703,322 (hereinafter Lusti et al) and its disclosure is herein incorporated by reference for simplification purposes.

The apparatus shown in the drawing comprises circuitry common to all the cars and circuitry individually associated with each car. Because the circuitry associated with each car is similar, the herein disclosed embodiment of the invention has been simplified where deemed practical by showing only the circuitry associated with car "a". As shown the circuitry individual to car "a" is identified with reference characters having an appended suffix (a) and it is to be understood that similar circuitry (not shown) is provided for each additional car of the system. The equipment shown herein is capable of use in an eight car system although for simplification purposes a four car system is disclosed.

In the drawing "and" gates are represented by "D" shaped outlines having their input terminals to the left of the "D" shaped outline and their output terminal to the right of the outline. As is well known each "and" gate applies a binary one line level signal to its output terminal only when a binary one level signal is applied to each of its input terminals and produces a binary zero level signal whenever a binary zero level signal is applied to one of its input terminals.

A plurality of nand gates are shown in the drawing represented by a "D" shaped outlines each having a small circle attached to the curved portion or output terminal of the outline to indicate the inversion of the "and" function. Each gate is supplied with a predetermined number of input terminals and each is commonly referred to in terms of its number of input terminals as for example — two input gate. The four input gate as shown is supplied with what is commonly referred to as an expander node to permit an increased number of input signals to be applied to the gate when required. It is also understood that not all the input terminals of each gate are utilized and it is to be understood that effectively a binary one level signal is applied to each input terminal shown unconnected. It is understood that each nand gate operates to produce a binary zero level signal only when a binary one level signal is applied to each of its predetermined number of input terminals and produces a binary one level signal whenever a binary zero level signal is applied to one of its input terminals.

In the following description a continuous binary one level signal or voltage is represented by the reference characters L10 and a binary zero level signal is represented by the reference characters HL1. The reference characters VAC represent a 120 V AC signal line.

Many of the signal lines are shown in more than one figure of the drawing. Whenever this occurs a bracketed numeral is appended to the reference characters identifying signal line to indicate the number of the figure to which the signal line is connected.

Auxiliary hall call registration switches S1, S2 . . . ST are shown connected to interface circuits SM1, SM2, . . . SMT for the main landing and landings 2-6, 7-11 and 12-T in FIG. 1. Because of the similarity of the circuitry associated with each of the landings only the circuitry associated with main landing will be described.

As shown push button switch S1 is connected between line HL1 and the input terminal of auxiliary hall call interface circuit SM1 associated with the main landing. The input terminal of the interface circuit is connected to one of the main terminals of bidirectional triode thyristor TR1, the cathode of diode CR1 and to one terminal of neon lamp NE1. Resistor R1 connects line VAC to the second terminal of neon NEL and resistor R3 connects line VAC to the anode of both diodes CR1 and CR3. Resistor R5 connects the cathode of diode CR3 to resistor R7 and capacitor C1 which has its second terminal connected to line HL1. The second terminal of resistor R7 is connected to the base of transistor Q1 and to resistor R9 which has its second terminal connected to line HL1. The emitter of transistor Q1 is connected to line HL1 and its collector is connected to one input terminal of four input nand gate NA1 which has its output terminal connected to the input terminal of four input nand gate NA3. Nand gate NA3 applies a binary one level signal along line SH1 signifying that an auxiliary hall call signal is registered for the main landing in response to the momentary closure of push-button switch S1.

As shown line SH1 is also connected to one input terminal of Nand gate NA5 and to resistor R11 which has its second terminal connected to line L10. Nand gate NA5 has its second input terminal connected to the collector of transistor Q1 and its output terminal connected to the base of transistor Q3. The emitter of transistor Q3 is connected to line HL1 and its collector is connected to both the anode of diode CR5 and resistor R13 which has its second terminal connected to line L10. The cathode of diode CR5 is connected to the gate of thyristor TR1 which has its second main terminal connected to line HL1.

Figure 2:
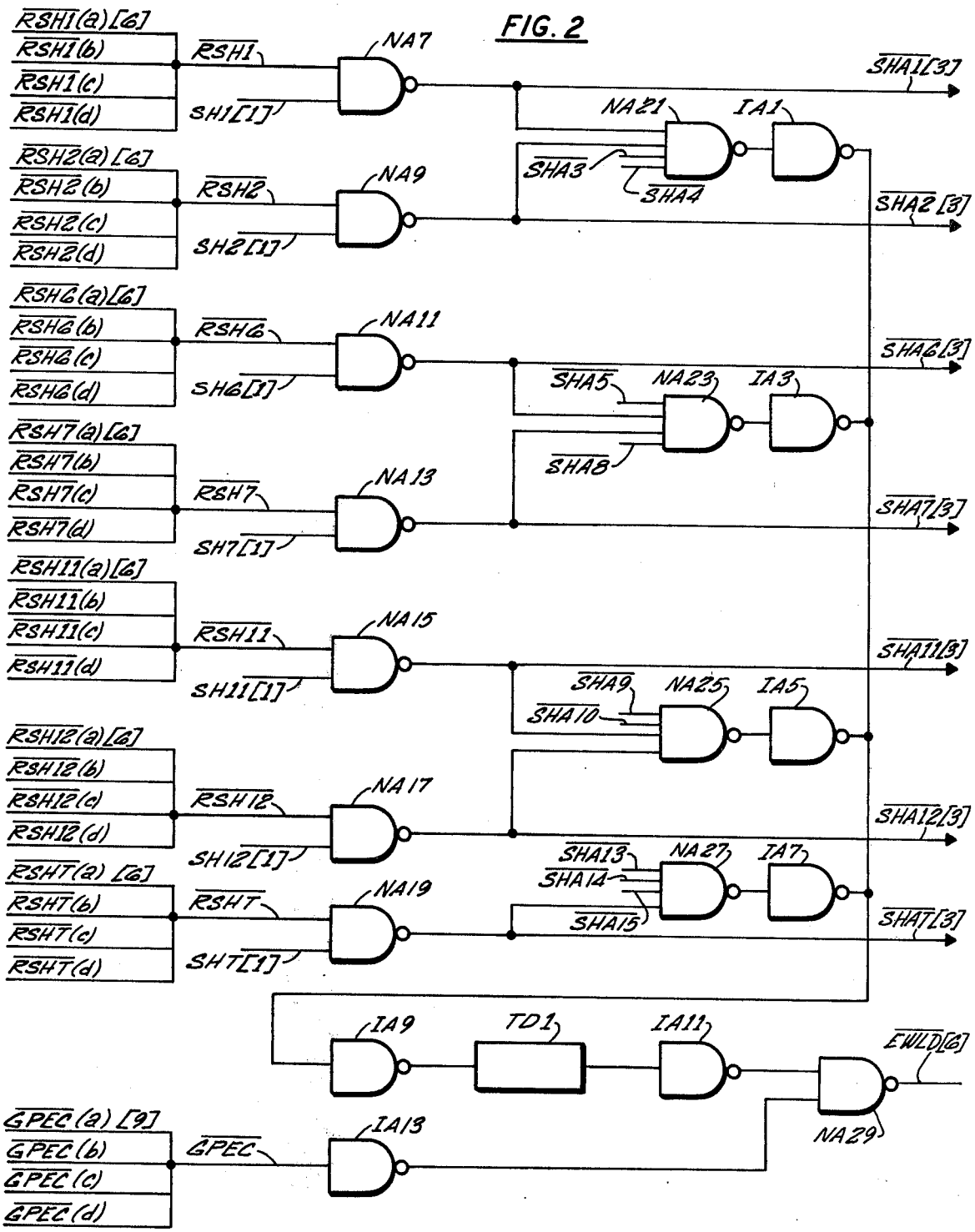
FIGS. 2, 3, 4 and 5 are a simplified schematic diagrams of the portion of the selection means associated with each of the cars.

Shown in FIG. 2 are a plurality of two input nand gates NA7, NA9 . . . NA19, each associated with one of the auxiliary hall call switches shown in FIG. 1. Because of the repetitive nature of the circuitry associated with each of the landings only a description of the circuitry associated with the main landing will be presented it being deemed sufficient to adequately describe the circuitry associated with the additional landings represented herein and those not shown. Two input nand gate NA7 has one input terminal connected to line SH1 and a second input terminal connected to lines $\overline{RSH1}$(a), $\overline{RSH1}$(b), $\overline{RSH1}$(c) and $\overline{RSH1}$(d) associated with each of the cars of the group. The output terminal of nand gate NA7 is connected to line $\overline{SHA1}$ and to one input terminal of four input gate NA21 which has its output terminal connected to the input terminal of inverting amplifier IA1. Nand gate NA21 has a second input terminal connected to the output terminal of nand gate NA9 associated with the second landing. Two additional unconnected input terminals of nand gate NA21 are connected to the circuitry associated with the third and fourth landings (not shown). Three additional similarly arranged four input gates NA23, NA25 and NA27 are provided to accommodate the remaining twelve landings. The output terminal of each of the three additional gates have their terminals respectively connected to the input terminals of inverting amplifiers IA3, IA5 and IA7. The output terminals of the four inverting amplifiers IA1, IA3, IA5 and IA7 are connected in common to the input terminal of inverting amplifier IA9 which has its output terminal connected to time delay circuit TD1 (to be described hereinafter). The output signal from time delay circuit TD1 is inverted by amplifier IA11 and applied to one input terminal of two input gate NA29 which applies a binary zero level signal along line $\overline{EWLD}$ whenever a second hall call signal is in registration for a predetermined time and one of the cars is available to respond to the registered call signal. Consequently as shown the second input terminal of nand gate N29 is connected to the output terminal of amplifier IA13 which has its input terminal connected to lines $\overline{GPEC}$(a) . . . $\overline{GPEC}$(d) to be hereinafter described.

Figure 3:
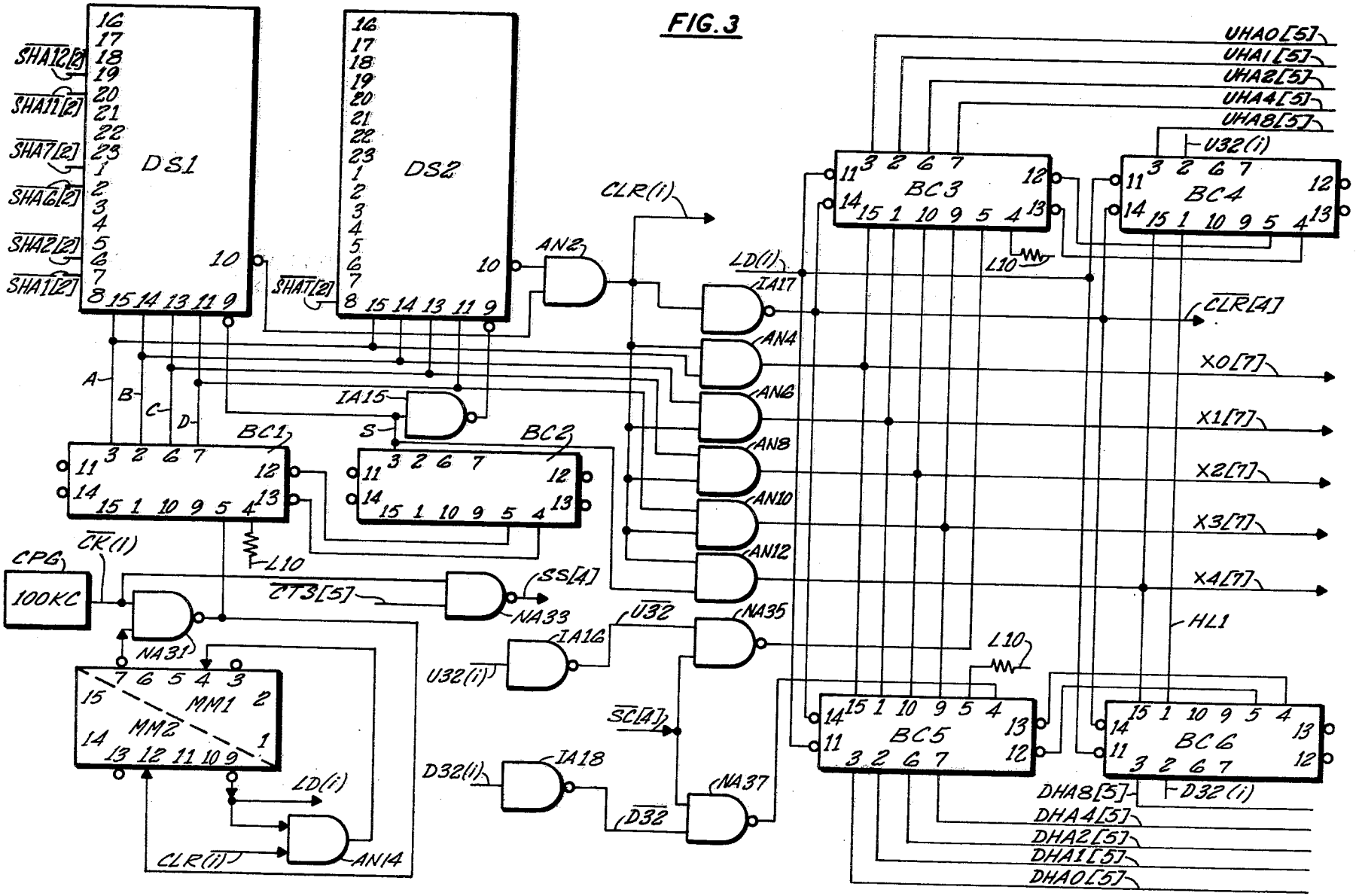

The portion of the selection means hereafter referred to as a landing scanner is shown in FIG. 3. The scanner includes a pair of data selectors DS1 and DS2 (FIG. 3) of the Signetics type 74150 or equivalent. As shown terminals 7, 6, 2, 1, 20 and 19 of data selector DS1 and terminal 8 of data selector DS2 are connected to lines $\overline{SHA1}$, $\overline{SHA2}$, $\overline{SHA6}$, $\overline{SHA7}$, $\overline{SHA11}$, $\overline{SHA12}$ and $\overline{SHAT}$ respectively to receive signals signifying that a car is to be selected to operate in response to an auxiliary hall call signal. It is to be understood that the terminals not shown connected are utilized to receive similar signals associated with the remaining landings (not shown). The four data select pins 15, 14, 13 and 11 of the pair of data selectors DS1 and DS2 are connected to the output pins 3, 2, 6 and 7 respectively of a four bit binary counter BC1 of the Signetics type 74193 or equivalent. A second binary counter BC2 of the same type has its output pin 3 connected to the strobe input pin 9 of data selector DS1 and to the input terminal of inverting amplifier IA15 which has its output terminal connected to the strobe input pin 9 of data selector DS2. Output pins 10 of data selectors DS1 and DS2 are connected to the two input terminals of AND gate AN2 which applies a binary signal along line CLR connected in common to one input terminal of two input AND gates AN4, AN6, AN8, AN10, AN12 and AN14 and to the input terminal of inverting amplifier IA17.

As shown binary counters BC1 and BC2 are cascaded to form the landing signal generating means by connecting the carry and borrow terminals 12 and 13 of counter BC1 to the count up and count down terminals 5 and 4 of counter BC2 respectively. The count up terminal 5 of counter BC1 is connected to the output terminal of two input NAND gate NA31 which has one of its input terminals to line $\overline{CK}$.

Figure 4:
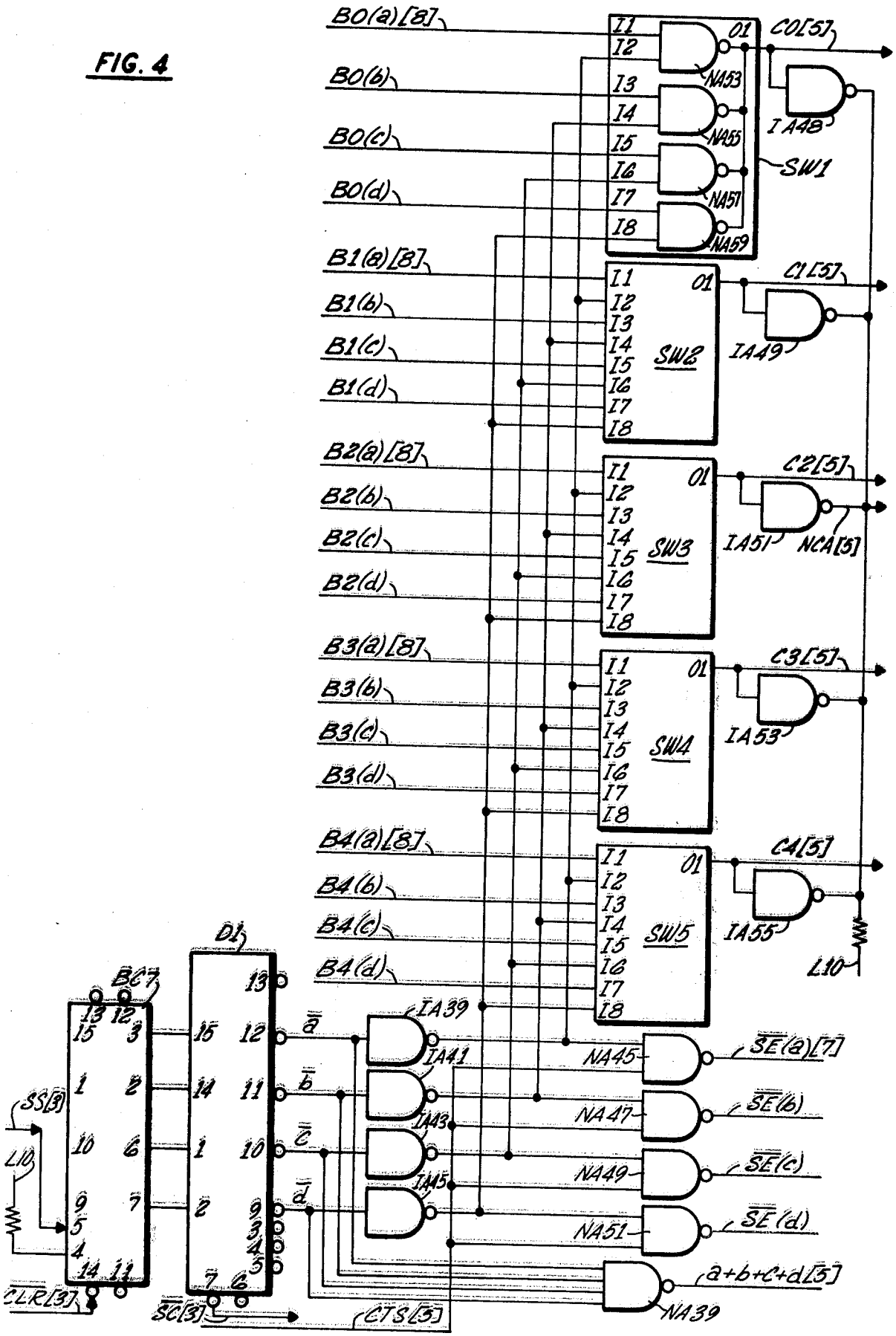

Clock pulse generator CPG is a free running type which produces pulsed signals at a frequency of 100KC having a pulse width of one-half the period. These signals are applied along line $\overline{CK}$, in addition to the above, to one input terminal of NAND gate NA33 which has its second input terminal connected to line $\overline{CTS}$. NAND gate NA33 applies gated pulsed signals along line SS to the count up input terminal 5 of binary counter BC7 (FIG. 4).

Two input NAND gate NA31 (FIG. 3) has its second input terminal connected to the $\overline{Q}$ output pin 7 of monostable multivibrator MM1 of the Fairchild type 96L02 or equivalent connected for operation in accordance with the manufacturer's recommendation. The trigger input pin 4 of multivibrator MM1 is connected to the output terminal of AND gate AN14 which has its second input terminal connected to the $\overline{Q}$ output terminal 9 of multivibrator MM2 which has its trigger input pin 12 connected to the output terminal of NAND gate NA31. Line LD connects the $\overline{Q}$ output terminal 9 of multivibrator MM2 to the load terminals 11 of four additional binary counters BC3, BC4, BC5 and BC6 of the Signetics type 74193 or equivalent identified herein as a pair of counters and shown in the right hand portion of FIG. 3.

The output terminals of the five AND gates AN4 to AN12 previously mentioned are respectively connected to lines X0, X1, X2, X3 and X4 and to data input pins 15, 1, 10 and 9 of binary counters BC3 and BC5 and to data input pin 15 of binary counters BC4 and BC5. Inverting amplifier IA17 has its output terminal connected in common to the clear input pins 14 of four binary counters BC3 to BC6.

Figure 5:
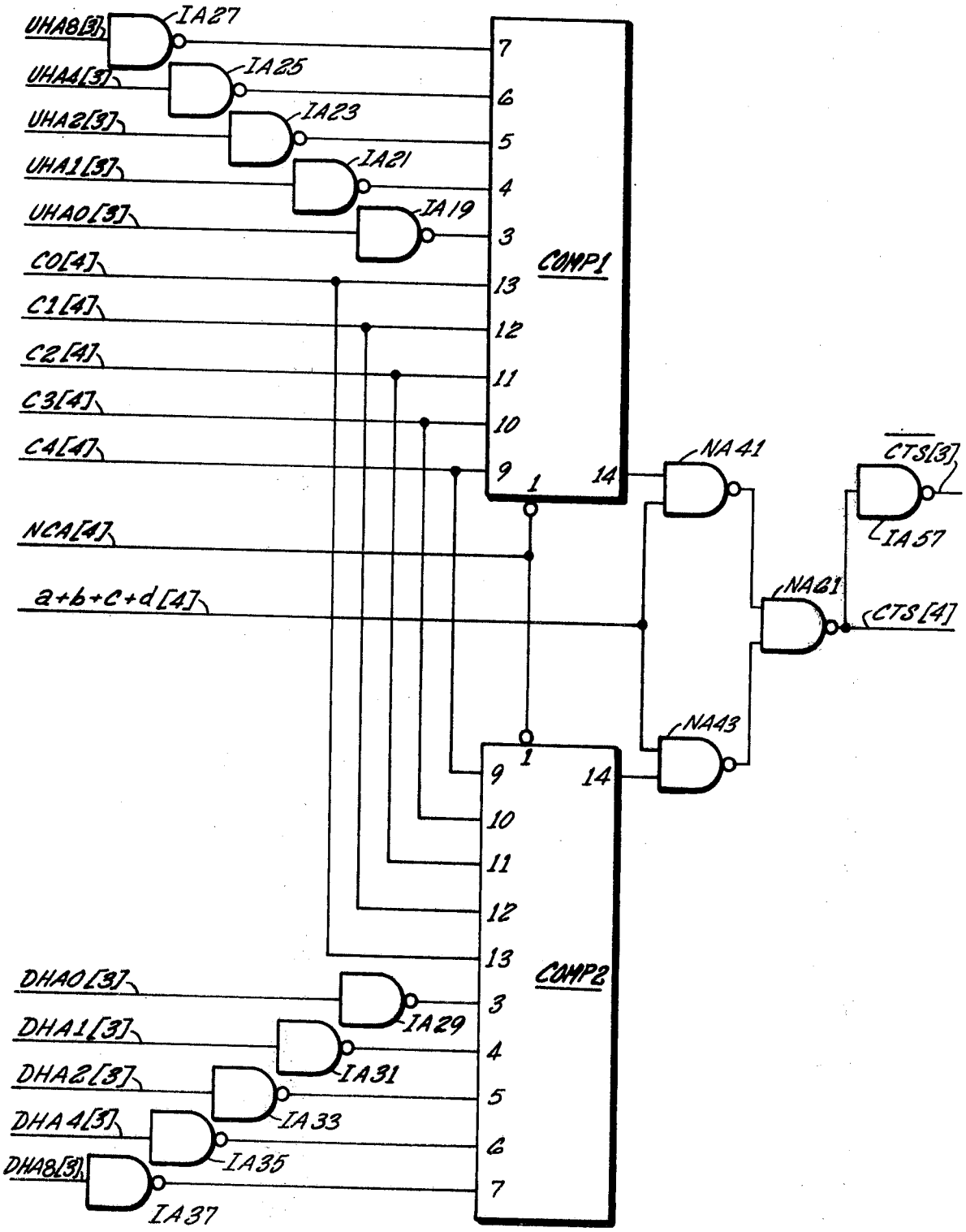

Binary counters BC3 and BC4 and binary counters BC5 and BC6 are cascaded in the same manner as binary counters BC1 and BC2 previously described. Counter BC3 has its count up input terminal 5 connected to the output terminal of NAND gate NA35 while the count down terminal 4 of counter BC5 is connected to the output terminal of NAND gate NA37. Gate NA35 has one of its input terminal connected by line $\overline{U32}$ to inverter IA16 which is connected to pin 2 of counter BC4 while gate NA37 has one of its input terminals connected by line $\overline{D32}$ to inverter IA18 which is connected to pin 2 of counter BC6. Both gates NA35 and NA37 have their second input terminals connected by line $\overline{SC}$ to the pin 7 of decoder D1 (FIG. 4) to be hereinafter described. Lines UHA0, UHA1, UHA2, UHA4 and UHA8 respectively connect the output pins 3, 2, 6 and 7 of counter BC3 and output pin 3 of counter BC4 to the input terminal of each of five inverting amplifiers IA19, IA21, IA23, IA25, IA27 shown in FIG. 5. Similarly lines DHA0, DHA1, DHA2, DHA4 and DHA8 respectively connect the output pins 3, 2, 6 and 7 of counter BC5 and pin 3 of counter BC1 to the input terminal of each of five additional inverting amplifiers IA29, IA31, IA33, IA35 and IA37 (FIG. 5).

Line $\overline{CLR}$ connects the output terminal of inverting amplifier IA17 (FIG. 3) to the clear input pin 14 of binary counter BC7 (FIG. 4) of the Signetics type 74193 or equivalent. Counter BC7 which forms part of car signal means which has its output pins 3, 2, 6 and 7 connected to the four input pins 15, 14, 1 and 2 respectively of decoder D1 of the Fairchild type 93L01 or equivalent. Output pins 12, 11, 10 and 9 of decoder D1 are respectively connected to the input terminal of each of four inverting amplifiers IA39, IA41, IA43 and IA45 and to the four input terminals of four input NAND gate NA39. As shown the output terminal of gate NA39 is connected by line a+b+c+d to one input terminal each of a pair of two input NAND gates NA41 and NA43 shown in FIG. 5.

The output terminals of the four amplifiers IA39, IA41, IA43 and IA45 are respectively connected to each of the input terminals I2, I4, I6 and I8 of five solid rectangular blocks SW1, SW2, SW3, SW4, and SW5 and to one input terminal of each of four NAND gates NA45, NA47, NA49 and NA51. Line $\overline{SE}$(a) connects the output terminal of NAND gate NA45 to the input terminal of inverting amplifier IA47 (FIG. 7) forming part of the selection means associated with car "a". Lines $\overline{SE}$(b), $\overline{SE}$(c) and $\overline{SE}$(d) similarly connect the output terminals of gates NA47, NA49 and NA51 to the selection means associated with the additional cars (not shown).

Because the circuitry contained in each of the solid line rectangular blocks SW1 to SW5 (FIG. 4), hereinafter referred to as switch blocks, is similar for simplification purposes only the circuitry contained in switch blocks SW1 will be described it being understood that this description is applicable to the remaining blocks. Switch block SW1 comprises four NAND gates NA53, NA55, NA57 and NA59 each having its output pin connected to output terminal O1. The input terminals I2, I4, I6 and I8 of switch block SW1 are respectively connected to an input terminal of each NAND gate NA53, NA55, NA57 and NA59. The second input terminal of each gate NA53, NA55, NA57 and NA59 is respectively connected to input terminals I1, I3, I5 and I7 of switch block SW1.

Figures 8, 11:
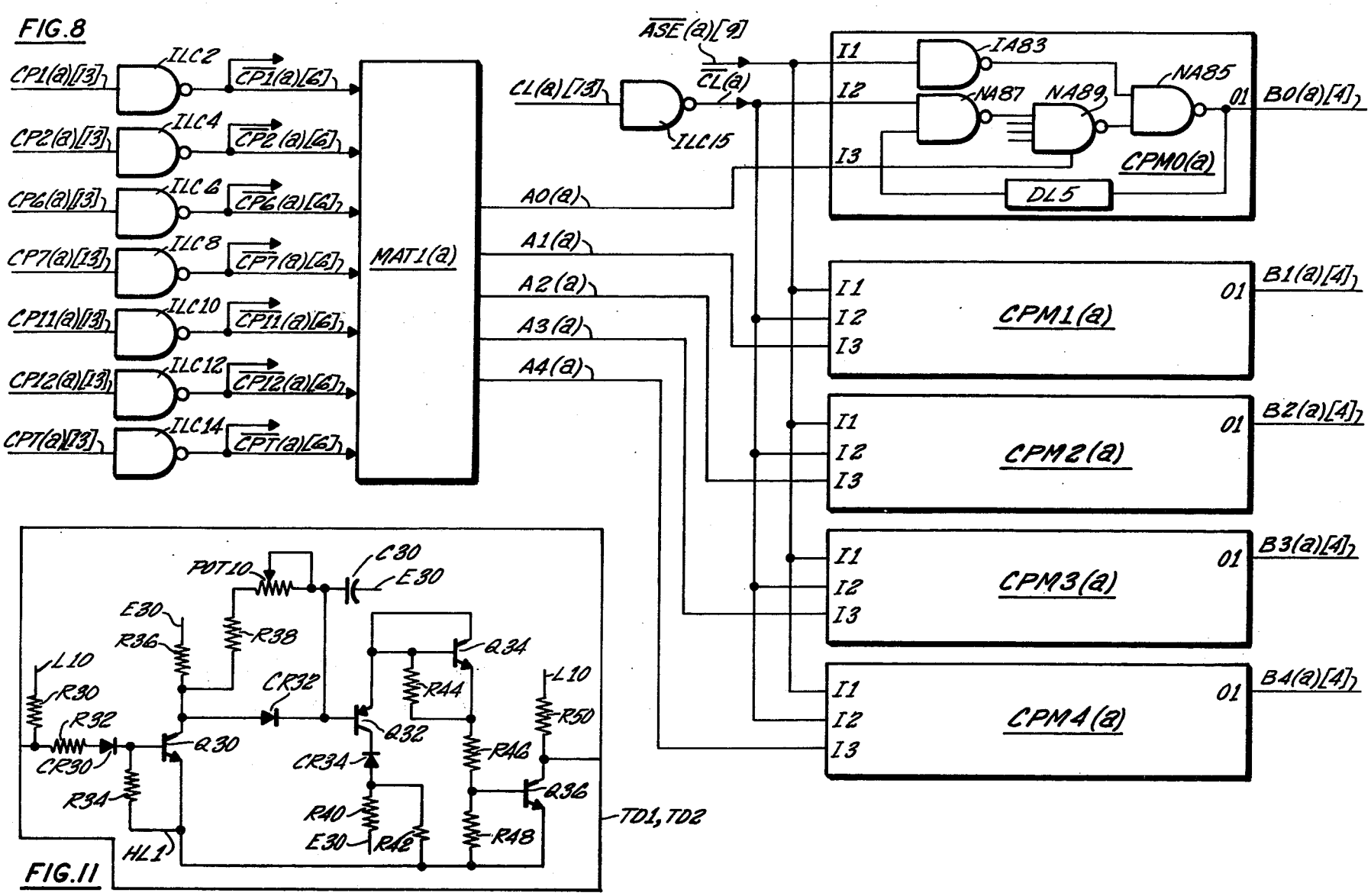

Lines B0(a), B1(a), B2(a), B3(a), and B4(a) respectively connect the input terminals I1 of switch blocks SW1, SW2, SW3, SW4 and SW5 to the output terminals of the car position memory circuits CPM0(a), CPM1(a), CPM2(a), CPM3(a) and CPM4(a) shown on FIG. 8 and forming part of the selection means associated with car "a". It is to be understood that input terminals I3, I5 and I7 of switch blocks SW1, SW2, SW3, SW4 and SW5 are similarly connected to the output terminals of the car position memory circuits associated with cars b, c and d (not shown).

Output terminals O1 of switch blocks SW1 to SW5 are individually connected to the input terminals of five inverting amplifiers IA48, IA49, IA51, IA53 and IA55. The output terminals of the five inverting amplifiers are connected in common and apply a signal along line NCA to the enable input pins 1 of the pair of comparators COMP1 and COMP2 shown in FIG. 5.

Lines C0, C1, C2, C3 and C4 respectively connect the output terminals O1 of switch blocks SW1, SW2, SW3, SW4 and SW5 to the input pins 13, 12, 11, 10 and 9 of the pair of comparators COMP1 and COMP2. The second set of input pins 3, 4, 5, 6 and 7 of comparator COMP1 are respectively connected to the output terminals of inverting amplifiers IA19, IA21, IA23, IA25 and IA27 while the second set of input pins 3, 4, 5, 6, and 7 of comparator COMP2 are respectively connected to the output terminals of inverting amplifiers IA29, IA31, IA33, IA35 and IA37. Equality pin 14 of comparator COMP1 is connected to one input terminal of NAND gate N41 which has its output terminal connected to one input pin of NAND gate NA61. Nand gate NA61 has its second input terminal connected to the output terminal of NAND gate NA43 which has its input terminal connected to equality pin 14 of comparator COMP2. Nand gate NA61 applies a signal to the input terminal of inverting amplifier IA57 which is connected by line $\overline{CTS}$ to one input terminal of NAND gate NA33 shown in FIG. 3. In addition, line CTS connects the output terminal of NAND gate NA61 to the second input terminals of NAND gates NA45, NA47, NA49 and NA51 shown in FIG. 4.

Figure 6:
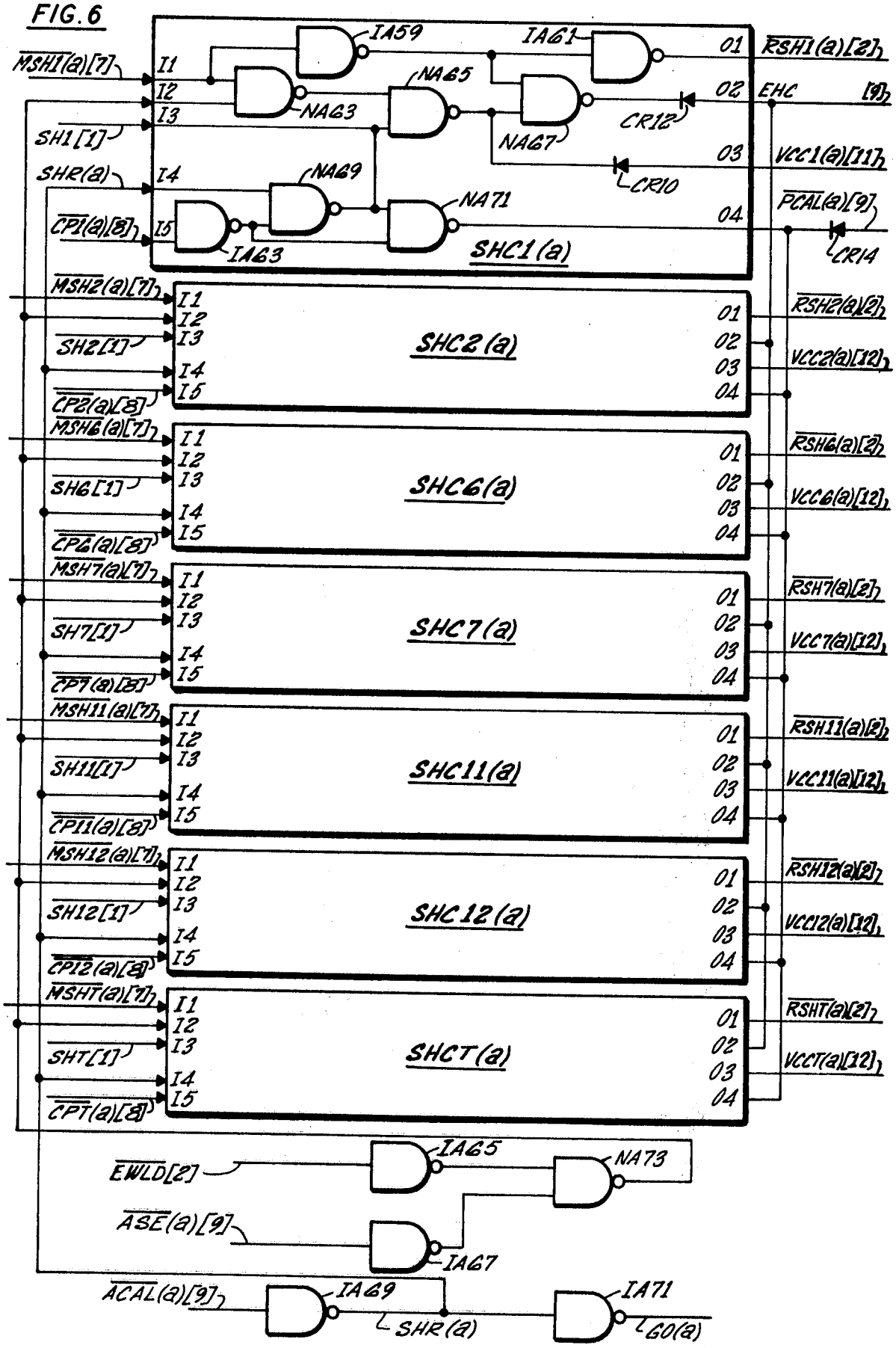
FIGS. 6, 7, 8 and 9 are a simplified schematic diagram of the portion of the selection means individual to a single car.

Shown in FIG. 6 are seven solid line rectangular blocks SHC1(a), SHC2(a), SHC6(a), SHC7(a), SHC11(a), SHC12(a) and SHCT(a) hereinafter referred to as logic circuits associated with each of the landings identified by the numerical addition to the reference characters SHC. It is understood that additional similar circuits are provided for the landings not so identified. Because each of the circuits are similar only a description of the circuitry contained in blocks SHC1(a) is given herein it being understood that the description applies to the circuitry associated with the remaining landings.

Logic circuit SHC1(a) includes a plurality of input terminals I1, I2, I3, I4 and I5 and output terminals O1, O2, O3 and O4. Inverting amplifier IA59 has its input terminal connected to terminal I1 of block SHC1(a) and applies a signal to the input terminal of inverting amplifier IA61 which has its output terminal connected to output terminal O1 of block SHC1(a). In addition input terminal I1 of block SHC1(a) is connected to one input terminal of two input gate NA63 which has its second input terminal connected to input terminal I2 of block SHC1(a). The output terminal of NAND gate NA63 is connected to one input terminal of two input gate NA65 which has its second input terminal connected to input terminal I3 of block SHC1(a). NAND gate N65 is connected to the input terminal of two input gate NA67 and to the cathode of diode CR10 which has its anode connected to output terminal O3 of auxiliary hall call circuit SHC1(a). NAND gate NA67 has its second input terminal connected to the output terminal of amplifier IA59 and its output terminal connected to the cathode of diode CR12 which has its anode connected to output terminal O2 of block SHC1(a). The signal on terminal I5 is inverted by amplifier IA63 and applied to one input terminal of both two input gates NA69 and NA71. NAND gate NA69 has its second input terminal connected to input terminal I4 of block SHC1(a) and its output terminal connected to both input terminal I3 of block SHC1(a) and to the second input terminal of NAND gate NA71 which has its output terminal connected to output terminal O4 of second hall call circuit SHC1(a).

As shown input terminals I1, I3 and I5 of auxiliary hall call circuit SHC1(a) are connected to receive signals applied along lines $\overline{MSH1}$(a), SH1 and $\overline{CP1}$(a). As indicated by the suffix numeral 1 these signals and associated with the first landing and it is to be understood that similarly referenced lines having appropriate numerical suffixes are connected to input terminals I1, I3 and I5 of the second hall call circuits associated with each of the remaining landings.

The input terminals I2 of each of the blocks shown in FIG. 6 are connected in common to the output terminal of two input gate NA73. NAND gate NA73 is separately connected to inverting amplifiers IA65 and IA67 which are respectively connected to lines $\overline{EWLD}$ (FIG. 2) and $\overline{ASE}$(a) to be described hereinafter. In addition input terminals I4 of each of the blocks are connected in common to the output terminal of inverting amplifier IA69 which has its input terminal connected to line $\overline{ACAL}$(a) also to be described hereinafter. The signal from amplifier IA69 is inverted by amplifier IA71 and applied along line GO to the control equipment to be described hereinafter.

Figure 12:
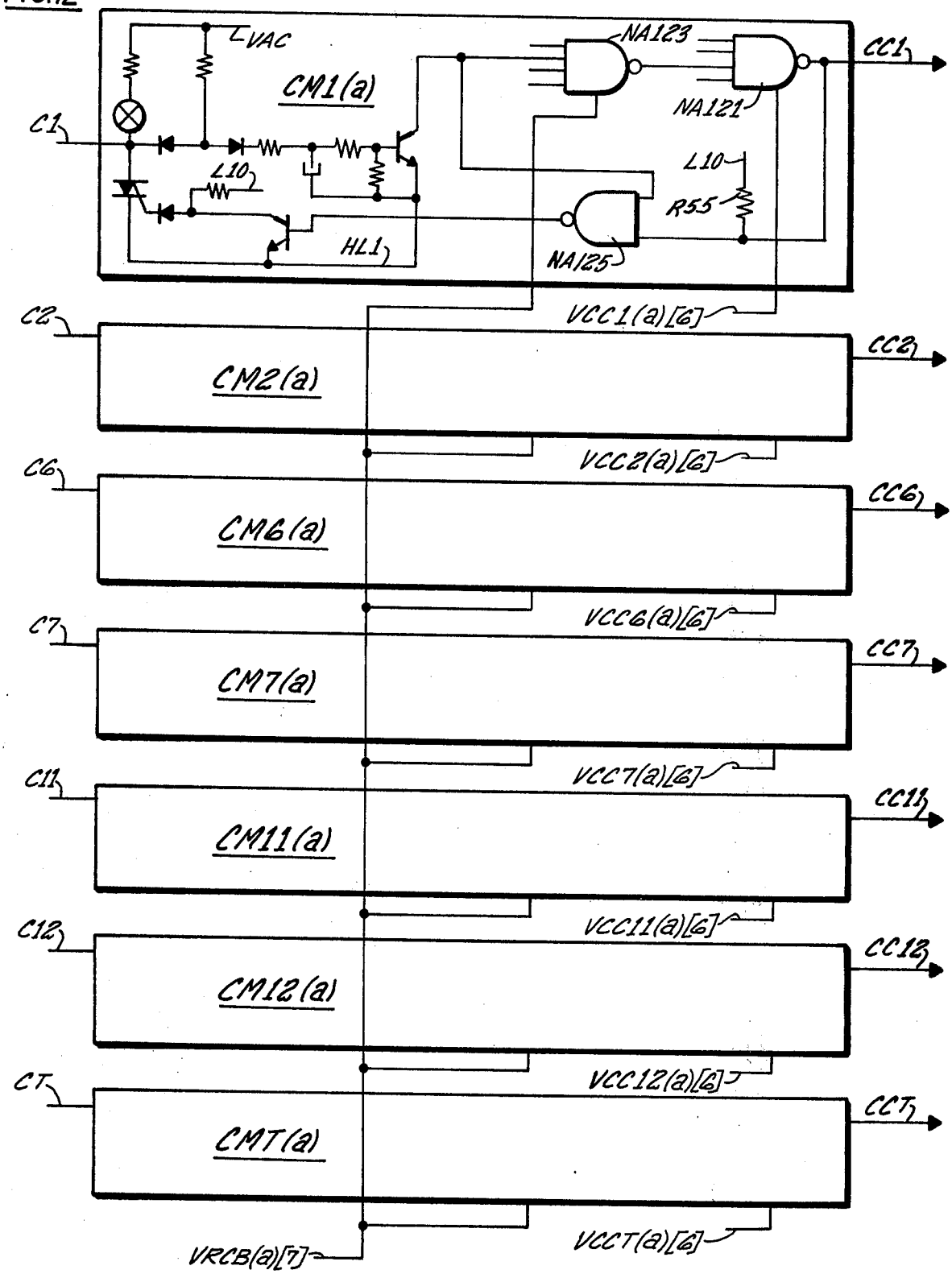
FIG. 12 is a simplified schematic diagram of the interface circuits for the car call registering devices associated with a single car.

The signals from output terminals O1 and O3 of block SHC1(a) are respectively applied along lines $\overline{RSH1}$(a) as indicated to the circuitry shown in FIG. 2 and along line VCC1(a) to the car call registration circuitry shown in FIG. 12. It is to be understood the blocks associated with the additional landings of the building apply similar signals along lines similarly identified by their appropriate suffix numerals.

Figure 9:
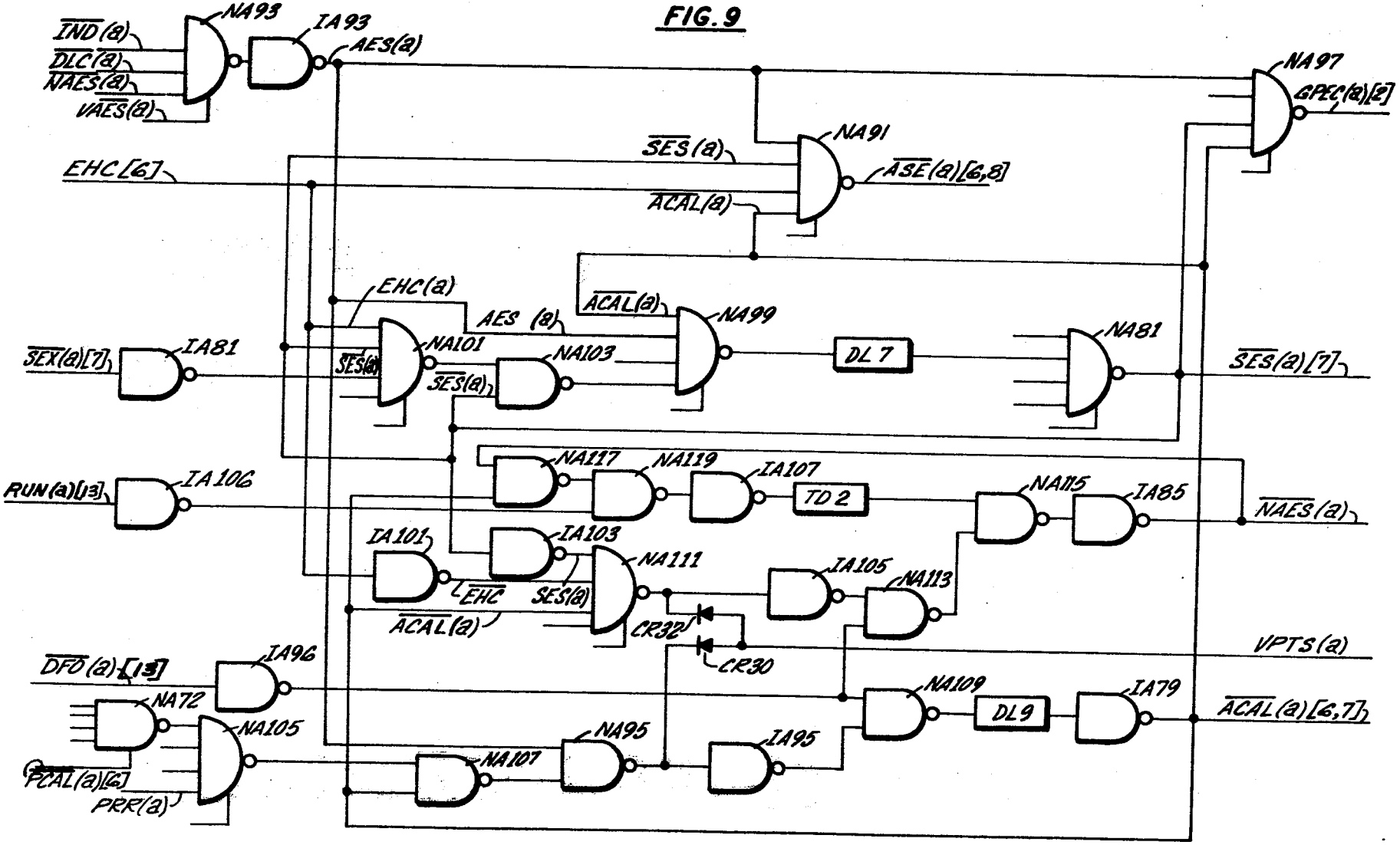

Output terminals O2 of each of the second hall circuits are connected in common to apply a binary signal along line EHC to the circuitry shown in FIG. 9. In addition output terminals O4 of each of the logic circuits are connected in common to the cathode of diode CR14 which has its anode connected to line $\overline{PCAL}$(a) to apply a signal to the expander node for four input NAND gate NA72 shown in FIG. 9.

Figures 7, 10:
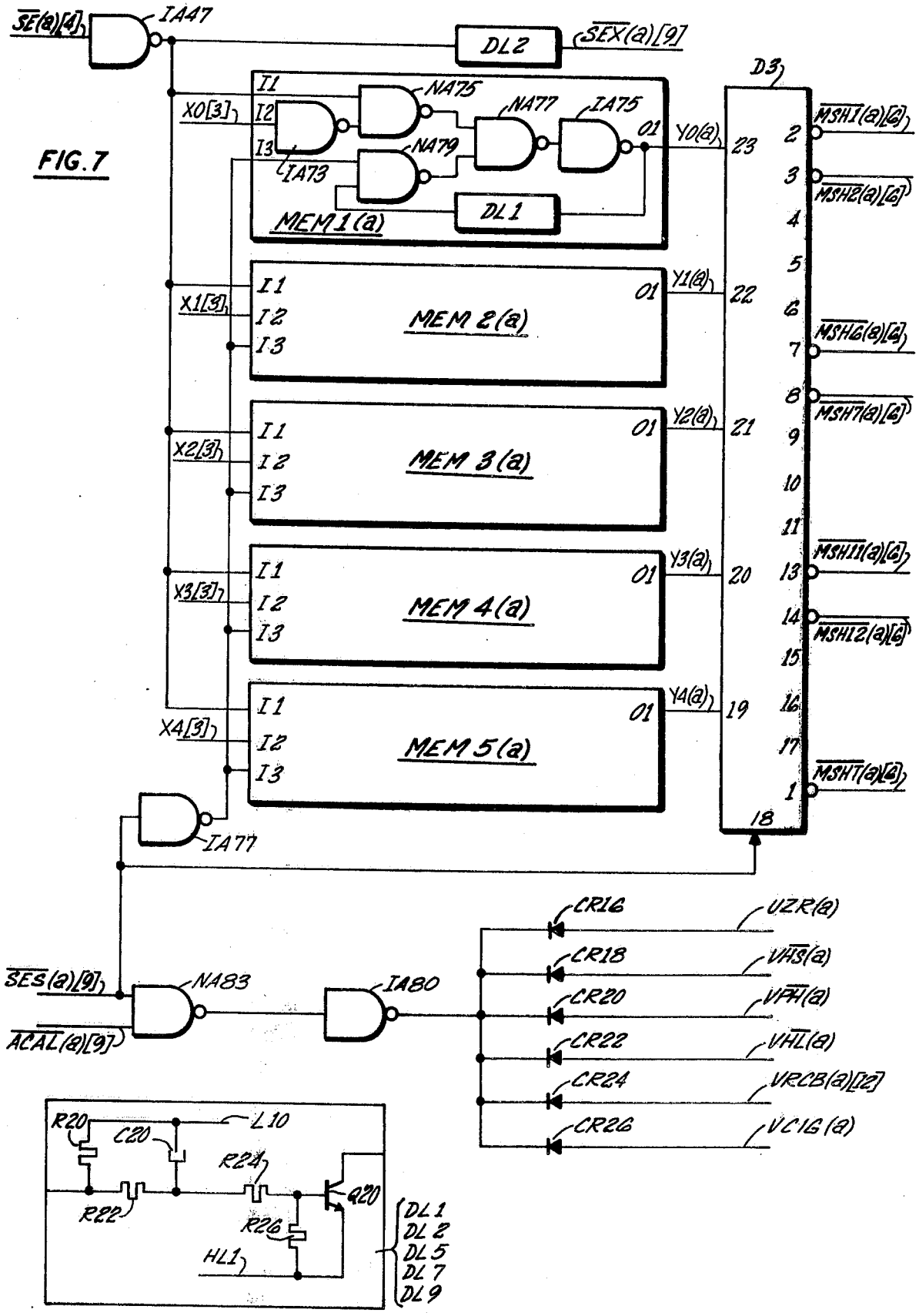
FIGS. 10 and 11 are simplified schematic diagrams of a pair of typical delay circuits.

Five memory circuits each having input terminals I1, I2 and I3 and on output terminal O1 are shown in FIG. 7 as solid line rectangular blocks MEM1(a), MEM2(a)-,—MEM5(a). Since the circuitry contained in each is similar only the circuitry associated with memory circuit MEM1(a) will be described it being understood that a similar description is applicable to the four additional circuits.

As shown the input terminal I2 of memory circuit MEM1(a) is connected to the input terminal of inverting amplifier IA73 which applies a signal to one input terminal of two input gate NA75. NAND gate NA75 has its second input terminal connected to input terminal I1 of memory circuit MEM1(a) and applies a signal to one input terminal of two input gate NA77. The output signal from NAND gate NA77 is inverted by amplifier IA75 and applied to output terminal O1 of memory circuit MEM1(a) and to the input terminal of inverting delay circuit DL1 shown schematically in FIG. 10. Two input NAND gate NA79 is separately connected to the output of delay circuit DL1 and to input terminal I3 of memory circuit MEM1(a) and applies a signal to the second input terminal of NAND gate NA77.

Each of the input terminals I1 of the five memory circuits are connected in common to the output of inverting amplifier IA47 which receives a signal applied to it along line $\overline{SE}$(a) from the output terminal of NAND gate NA45 (FIG. 4). The input terminals I3 of the five memory circuits are also commonly connected to the output terminal of inverting amplifier IA77 which has its input terminal connected by line $\overline{SES}$(a) to the output terminal of four input gate NA81 shown in FIG. 9. The five remaining input terminals I2 of each of the five memory circuits are separately connected by lines X0, X1—X5 to the respective output terminals of gates AN4, AN6, AN8, AN10 and AN12 shown in FIG. 3. Lines Y0(a), Y1(a), Y2(a), Y3(a) and Y4(a) respectively connect the separate output terminals O1 of each of the memory circuits to input pins 23, 22, 21, 20 and 19 of decoder D3 of the Signetics type 74154 or equivalent.

Decoder D3 applies a signal from one of the output pins 2, 3, 7, 8, 13, 4 and 1 along lines $\overline{MSH1}$(a), $\overline{MSH2}$(a), $\overline{MSH6}$(a), $\overline{MSH7}$(a), $\overline{MSH11}$(a), $\overline{MSH12}$(a) and $\overline{MSHT}$(a) to the input pins I1 of the logic circuits previously described and shown in FIG. 6. It is to be understood that the unconnected output pins of decoder D3 applies signals along similarly referenced lines associated with the additional landings of the building and connected to similar logic circuits to those shown in FIG. 6 (not shown). The strobe input pin 18 of decoder D3 is connected to line $\overline{SES}$(a).

Line $\overline{SES}$(a) is also connected to one input of two input gate NA83 which also receives a signal applied to its second input terminal along line $\overline{ACAL}$(a) from inverting amplifier IA79 shown in FIG. 9. Amplifier IA80 inverts the signal from NAND gate NA83 and applies it to the cathode of a plurality of diodes CR16, CR18, CR20, CR22, CR24 and CR26. Lines UZR(a), $\overline{VHS}$(a), $\overline{VPH}$(a), $\overline{VHL}$(a), VRCB(a) and $\overline{VCIG}$(a), respectively connect the anodes of diodes CR16, CR18 --- CR26 to the control equipment of the elevator system associated with car "a". As mentioned these signals are particularly suitable for application to the control system similar to that disclosed in U.S. Pat. No. 3,703,222.

A second inverting delay circuit DL2 is shown in FIG. 7 with its input terminal connected to the output terminal of amplifier IA47. This delay circuit of the type shown in FIG. 12 applies the complement of the signal it receives from amplifier IA47 along line $\overline{SEX}$(a) to inverter IA81 shown in FIG. 9.

Lines CPl(a), CP2(a), CP6(a), CP7(a), CP11(a), CP12(a) and CPT(a) are shown in FIG. 8 connected to the input terminals of inverting level converters ILC2, ILC4, ILC6, ILC8, ILC10, ILC12 and ILC14 of any well known type. It is to be understood that a floor selector associated with car "a" applies a signal along one of these lines or similar ones not shown to signify the position of car "a" with respect to one of the landing of the building. The level converters are connected to a matrix MAT1(a) of any standard design such as a diode matrix which converts the signal applied to it to a five bit binary coded signal representing the floor landing at which the car is positioned. This five bit binary signal is applied along lines AO(a), A1(a), A2(a), A3(a) and A4(a) to each separate input pin I3 of five separate car position memory circuits shown as five solid line rectangular blocks CPMO(a), CPM1(a), CPM2(a), CPM3(a) and CPM4(a) in FIG. 8.

Each of the car position memory circuis include two additional terminals I1 and I2 and an output terminal 01. Since the circuitry contained in each block is similar only car position memory circuit CPMO(a) will be described it being understood that description also applies to the remaining four circuits.

Inverting amplifier IA83 has its input terminal connected to input terminal I1 of block CPMO(a) and its output terminal connected to one input terminal of two input gate NA85. NAND gate NA85 has its output terminal connected to output terminal 01 of the memory circuit and to the input terminal of inverting delay circuit DL5 (shown in FIG. 10). Delay circuit DL5 has its output terminal connected to one input of two input gate NA87 which has its second input terminal connected to the input terminal I2 of memory circuit CPMO(a). NAND gate NA87 applies a signal to one input terminal of five input gate NA89 which has its expander node connected to input terminal I3 of car position memory circuit CPMO(a).

Input terminals I2 of the five car position memory circuits shown in FIG. 8 are connected in common to the output terminal of inverting level converter ILC15 which has its input terminal connected by line CL to the floor selector of the control equipment associated with car "a". In addition input terminals I1 of the five memory circuits CPMO(a), --- CPM4(a) are connected in common by line $\overline{ASE}$(a) to the output terminal of NAND gate NA91 shown in FIG. 9. The output terminals 01 of the five memory circuits are separately connected by lines BO(a), B1(a), B2(a), B3(a) and B4(a) to the input terminals I1 of the five switching circuits previously described with respect to FIG. 4.

Four input NAND gate NA93 shown in the upper lefthand corner of FIG. 9 has one of its input pins connected by line $\overline{NAES}$(a) to the output terminal of inverting amplifier IA85 (FIG. 9). Although the remaining input terminals of NAND gate NA93 are shown unconnected it is to be understood that they are available to be connected to the elevator control circuitry associated with car "a" to receive signals signifying that car "a" is not operating in a predetermined manner in response to the primary hall call signals or its car call signals or that the car is delayed at a landing for some reason such as a person holding its doors open. The signal produced by NAND gate NA93 is inverted by amplifier IA93 and applied along line AES(a) to one input terminal of two input gate NA95 and to one input terminal of each of three four input gates NA91, NA97 and NA99.

Four input NAND gate NA91 has a second input terminal connected to line EHC(a) as previously described and its third and fourth input terminals connected by lines $\overline{SES}$(a) and $\overline{ACAL}$(a) to the output terminals of four input NAND gate NA81 and inverting amplifier IA79 respectively. This gate applies a signal along line $\overline{ASE}$(a) to the circuitry shown in FIGS. 6 and 8 signifying that car "a" is available to be selected to operate in response to a registered auxiliary hall call.

As previously described a signal is applied along line $\overline{SEX}$(a) to inverting amplifier IA81 shown to the left of FIG. 9 with its output terminal connected to one input terminal of four input gate NA101. NAND gate NA101 has two additional input pins each connected separately to line EHC previously described with respect to FIG. 6 and to NAND gate NA81 (FIG. 9). The signal from NAND gate NA101 is applied to one input terminal of two input gate NA103 which has its second input pin connected by line $\overline{SES}$(a) to gate NA81 and applies a signal to a second input terminal of four input gate NA99. NAND gate N99 has an additional input pin connected by line $\overline{ACAL}$(a) to the output terminal of amplifier IA79 and applies a signal to the input of delay circuit DL7. Delay circuit DL7 of the type shown in FIG. 10 inverts the signal it receives and applies it to one input terminal of four input NAND gate NA81. NAND gate NA81 applies a binary zero level signal along line $\overline{SES}$(a) whenever car "a" is selected as the closest car to a landing for which an auxiliary hall call is registered.

Four input NAND gate NA105 shown in the lower lefthand corner of FIG. 9 combines the signal it receives from NAND gate NA72 with a signal applied to it along line $\overline{PRR}$(a) from the control equipment associated with car "a" and applies a binary signal to one input terminal of two input NAND gate NA107. NAND gate NA107 has its second input terminal connected to line $\overline{ACAL}$(a) and applies a binary signal to the second input terminal of NAND gate NA95. NAND gate NA95 applies a binary zero level signal to the cathode of diode CR30 to cause the control equipment to stop car "a" at a landing for which an auxiliary hall call signal is registered whenever car "a" is signified as being located at that landing.

In addition, the signal from the output terminal of gate NA95 is inverted by amplifier IA95 and applied to one terminal of two input NAND gate NA109. Nand gate NA109 has its second input terminal connected to the output of inverting amplifier IA96 to receive the complement of the signal applied along line $\overline{DFO}$(a) from the door control equipment associated with car "a". NAND gate NA109 has its output terminal connected to inverting delay circuit DL9 of the type shown in FIG. 10 which applies a signal to inverter IA79. Inverter IA79 applies a binary zero level signal along line $\overline{ACAL}$(a) whenever car "a" is available to be operated by a passenger at a landing for which a registered auxiliary hall call is registered.

The signals on lines EHC and $\overline{SES}$(a) are inverted by amplifiers IA101 and IA103 respectively and applied separately to two input terminals of four input gate NA111. NAND gate NA111 combines these two signals with a signal applied along line $\overline{ACAL}$(a) to its third input terminal and applies a binary zero level signal to the cathode of diode CR32 whenever a car selected as closest to a landing for which an auxiliary hall call is registered is signified as being located at that landing. The anode of both diodes CR30 and CR32 are connected by line VPTS to the control equipment to cause car "a" to stop at that landing in response to the binary zero level signal.

In addition to being connected to diode CR32 gate NA111 is connected to amplifier IA105 which has its output terminal connected to one input terminal of two input NAND gate NA113. NAND gate NA113 has its output terminal connected to one input terminal of two input NAND gate NA115 which has its output terminal connected to amplifier IA85. The output signal from inverter IA85 is applied along line $\overline{NAES}$(a) to one input terminal of two input NAND gate NA117 which has its second input terminal connected to line $\overline{ACAL}$(a). The output terminal of NAND gate NA117 is connected to one input terminal of two input NAND gate NA119 which has its second input terminal connected to the output pin of inverting amplifier IA106. Inverting amplifier IA106 has its input pin connected to the control equipment by line RUN(a) and receives a signal signifying that car "a" is in motion. The output signal from NAND gate NA119 is inverted by amplifier IA107 and applied to non-inverting time delay circuit TD2. Time delay circuit TD2 of the type shown in FIG. 11 has its output terminal connected to the second input terminal of NAND gate NA115. NAND gate NA115 has its output terminal connected to the input of amplifier IA85 which applies a binary zero level signal along line $\overline{NAES}$(a) whenever car "a" is not in a condition to operate in response to an auxiliary hall call.

A simplified schematic diagram of the delay circuits herein identified by the reference characters DL with an appropriate numerical suffix is shown in FIG. 10. As shown, the circuit includes an input terminal connected to a pair of resistors R20 and R22. The second terminal of resistor R22 is common to both resistor R24 and capacitor C20. Both capacitor C20 and resistor R20 have their second terminals connected to line L10 while the second terminal of resistor R24 is connected to both the base of transistor Q20 and one terminal of resistor R26. The emitter of transistor Q20 and the second terminal of resistor R26 are connected to line HL1 and the collector of the transistor Q20 is connected to the output terminal of the delay circuit.

The time delay circuit identified by the reference characters with an appropriate suffix numeral is shown in simplified form in FIG. 11. As shown therein the input terminal of time delay circuit TD1, TD2 is connected to both resistors R30 and R32. The second terminal of resistor R32 is connected to the anode of diode CR30 which has its cathode connected to both the base of transistor Q30 and resistor R34. Transistor Q30 has its collector connected to resistors R36 and R38 and to the anode of diode CR32. The second terminal of resistor R38 is connected to one end of potentiometer Pot 10 which has its second end connected to capacitor C30, the cathode of diode CR32 and to the base of transistor Q32. Resistors R40 and R42 are connected in common across voltage line E30 of approximately 35VDC and line HL1 to apply a bias voltage of suitable magnitude through diode CR34 to the collector of transistor Q32. Transistor Q32 has its emitter connected in common to the base and collector of transistor Q34 and to base resistor R44. The second terminal of base resistor R44 is connected in common to the emitter of transistor Q34 and to one terminal of resistor R46. The second terminal of resistor R46 is connected to base resistor R48 and to the base of transistor Q36. Resistor R50 is connected in common to the output terminal of time delay TD1 and to the collector of transistor Q36. Line L10 is connected in common to the second terminal of resistors R30 and R50 while line HL1 is common to the second terminals of resistors R34, R42 and R48 and to the emitters of transistors Q30 and Q36. In addition line E30 is common to the second terminals of resistor R36 and capacitor C30. It is to be understood that the application of a binary one level signal to the input of time delay circuit TD1 causes it to produce a binary one level signal at its output terminal for a predetermined time which is adjusted by means of potentiometer POT 10. Thereafter time delay circuit TD1 produces a binary zero level signal after the predetermined time has elapsed.

FIG. 12 is a simplified schematic diagram of the car call memory circuits CM1(a), CM2(a) . . . CMT(a) associated with the control equipment of a car "a" for receiving signals along lines C1, C2 . . . CT from the car call buttons of car "a" associated with the landings identified by the suffix numeral. Because of the similarity of each of these circuits only the circuit CM1(a) associated with a first landing car call button is shown schematically. As shown, this circuit is similar to the circuit SM1 shown in FIG. 1 and as a result, only the interconnections which differ from that circuit will be described it being understood that the description given with respect to the circuit SM1 shown in FIG. 1 applies to the circuits shown in FIG. 12.

The output terminal of the car call memory circuit CM1(a) is connected to the output terminal of four input NAND gate NA121 shown in the upper right hand corner of call memory circuit CM1(a). NAND gate NA121 has one of its input terminals connected to the output terminal of four input NAND gate NA123 and its expander node connected by line VCC1(a) to the anode of diode CR10 shown in FIG. 6. The expander node of the four input NAND gate NA3 shown in FIG. 1 was left unconnected. In addition, the expander node of NAND gate NA123 shown in the block CM1(a) is connected in common with the expander nodes of correspondingly arranged gates associated with the additional blocks CM2, CM6 . . . CMT by line VRCB(a) to the anode of diode CR24 shown in FIG. 7. Again, the expander nodes of the correspondingly arranged NAND gates associated with the blocks SM1, SM2 . . . SMT shown in FIG. 1 are left unconnected.

Figure 13:
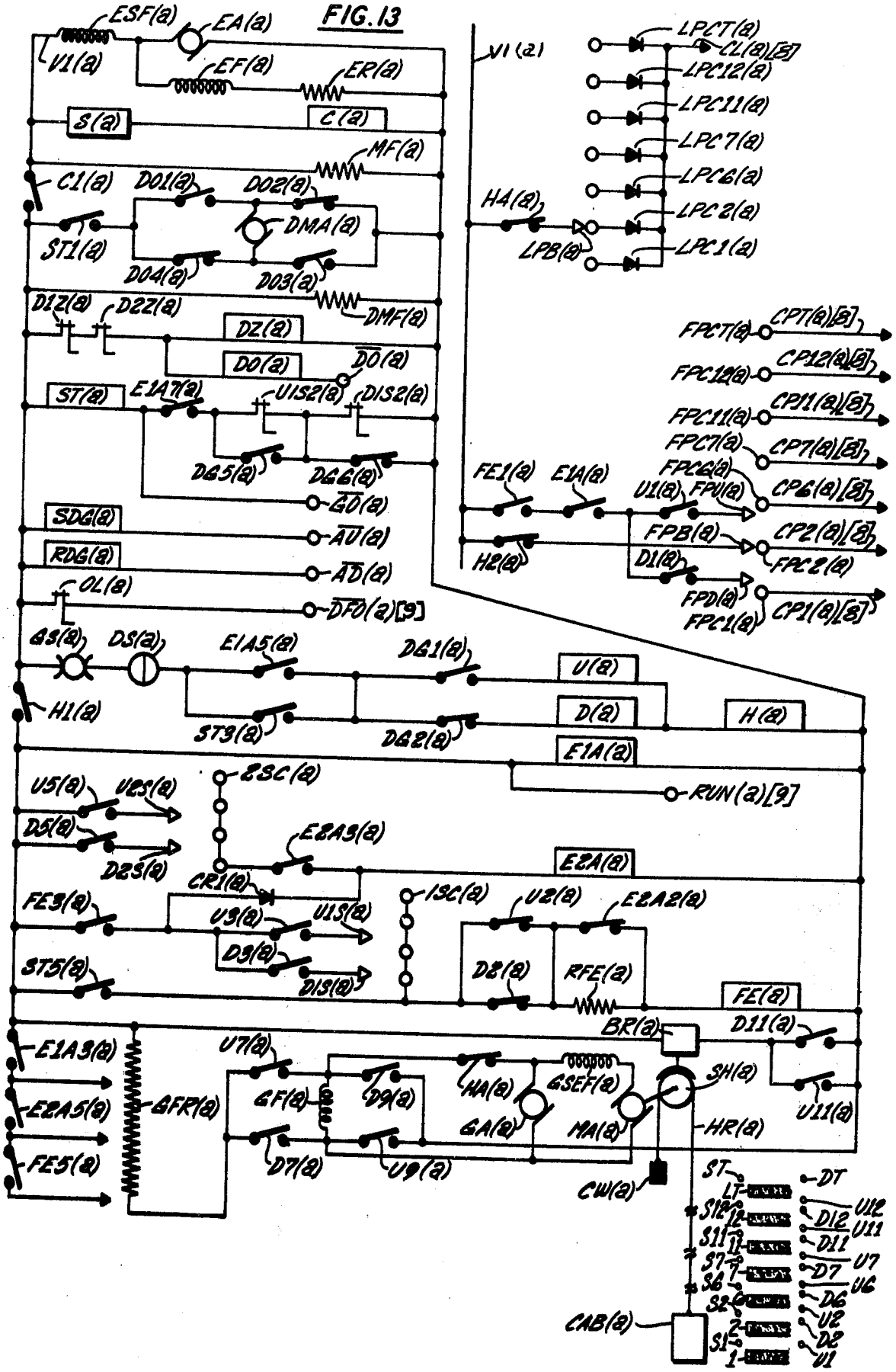
FIG. 13 is a simplified schematic diagram of part of the control equipment individual to an elevator car.

A portion of the control equipment associated with car "a" is shown in FIG. 13. This apparatus is well known and is described more completely in U.S. Pat. No. 3,614,995 and as a result for purpose of reducing this disclosure only the parts related to the present invention will be described in order to enable anyone of ordinary skill in the art to practice this invention.

Elevator car CAB(a) and counterweight CW(a) are suspended by hoist ropes HR(a) from sheave SH(a). Elevator car CAB(a) serves sixteen landings segregated into four zones of groups of landings including the first landing, landings 2-6, landings 7-11 and landings 12-T. The landings shown are equipped with primary hall call buttons, U1, D2, U2 ... U12, DT and auxiliary hall call buttons S1, S2 . . . ST.

Sheave SH(a) is mounted on the shaft of motor armature MA(a) which is connected across generator GA(a) and series field GSEF(a) of the d-c generator in the well known Ward Leonard arrangement.

Elevator car CAB(a) is equipped with door operating means including a door motor having an armature DMA(a) and a field DMF(a), door contacts DS(a) associated with the hoistway door switches (not shown), gate contacts GS(a) and car doors fully opened switch OL(a) associated with the car door switch (not shown). As is typical each car includes a car operating panel housing car call buttons shown as CC1, CC2 . . . CCT.

Also shown are the relevant portions of a typical landing selector machine which includes an advancer carriage (not shown) and a scynchronous panel (not shown). The advancer carriage moves in the same direction as the car but in advance thereof and includes advanced floor position brushes FPU(a) and FPD(a) arranged to contact floor position contacts FPC1(a), FPC2(a) . . . FPCT(a). It is well known that when car "a" is located at predetermined distance from a landing and is approaching that landing one of the floor position brushes FPU(a) or FPD(a) applies a voltage to the floor position contact associated with that landing signifying that car "a" is located at a position from which it is to be decelerated if it is to stop at that landing in a prescribed manner. As shown lines CP1(a), CP2(a) . . . CPT(a) separately connect each of the floor position contacts CP1(a), CP2(a) . . . CPT(a) to the circuitry shown in FIG. 8.

The synchronous panel moves in the same direction of the car but therewith and includes a landing position brush LPB(a) arranged to contact landing position contacts LPC1(a),LPC2(2) . . . LPCT(a) separately connected to the anodes of a plurality of diodes shown in FIG. 13. Line CL(a) common to the cathodes of each of the diodes is also connected to the circuitry shown in FIG. 8.

Line RUN(a) connects the normally deenergized side of contact HI(a) (FIG. 13) to inverting level converter to the control system which applies a signal to the circuitry shown in FIG. 9 to apply a potential thereto to indicate that car "a" is in motion.

In order to understand how the apparatus of the present invention cooperates with an elevator control system to select one of a plurality of cars being operated in a predetermined manner in response to registered primary hall calls and car calls it will be assumed the apparatus of the present invention is connected to the well known elevator control system disclosed in U.S. Pat. No. 3,703,222 hereinafter Lusti et al. It will also be assumed that the elevator control system disclosed in Lusti et al is operating a plurality of cars a, b, c and d as a supervised group in response to registered primary hall calls and car calls. As disclosed in U.S. Pat. No. 3,703,222 the control system applies binary one level signals along lines $\overline{IND}$(a) and $\overline{DLC}$(a) signifying that car "a" is being operated as a member of a supervised group and that it is not being significantly delayed at a landing. It will be assumed that these signals are applied to two input terminals of NAND gate NA93 shown in FIG. 9. It will also be assumed that each car is traveling in its hatchway and as a result the control system disclosed in Lusti et al applies binary one level signals along lines $\overline{PRR}$(a), RUN(a), $\overline{DFO}$(a) to the circuitry shown in FIG. 9 associated with car "a" and to similar circuitry (not shown) associated with car b, c and d.

It is understood that as car "a" moves through the hatchway the synchronous panel of its associated floor selector moves in synchronism with the car and the advancer panel moves in the same direction as the synchronous panel but in advance thereof by a predetermined distance. As a result when car "a" arrives at a predetermined distance from a landing advancer brush FPU(a) or FPD(a) (FIG. 13) applies a voltage to one of the floor position contacts FPC1(a), FPC2(a) . . . FPCT(a). Each contact is connected to an inverting level converting circuit shown in FIG. 8 which applies a binary zero level signal along that one of the lines $\overline{CP1}$(a), $\overline{CP2}$(a) --- $\overline{CPT}$(a) corresponding to the landing contact to matrix MAT1(a). When the car is stopped at a landing as is well known the advancer and synchronous panel are in synchronism and as a result floor position brush FPB(a) (FIG. 13) applies a voltage to the contact corresponding to landing at which the car is located.

The synchronous panel is also provided with a brush LPB(a) which applies a voltage to one of the contacts LPC1(a), LPC2(a) --- LPCT(a) whenever the car is stopped at a landing. These contacts connected to the anodes of a corresponding number of diodes which have their cathodes connected in common to the input terminal of an inverting level converter shown in FIG. 8. As a result a binary zero level signal is applied along line $\overline{CL}$(a) whenever car "a" is stopped at any landing.

It will further be assumed that cars "a" and "b" are respectively located at the second and twelfth landing and traveling in the up direction while cars "c" and "d" are respectively located at the top and eleventh landings and traveling in the down direction. As a result when the advancer brush FPU(a) of the selector associated with car "a" engaged floor position contact FPC2(a) a binary zero level signal was applied along line CP2(a) to the input of matrix MAT1(a). As a result matrix MAT1(a) applied a five bit binary signal representing the second landing along lines AO(a), Al(a) --- A4(a) to the input terminals I3 of each of the five car position memory circuits CPMO(a), CPM1(a) --- CPM4(a). At the same time a binary one level signal is applied along line $\overline{CL}$(a) to the input terminals I2 of the five car position circuits because as assumed car "a" is traveling in the up direction and as a result contact H4(a) (FIG. 13) is actuated to the opened position. Simultaneously NAND gate NA91 (FIG. 9) applies a binary zero level signal along line $\overline{ASE}$(a) to input terminal I1 of the five car position memory circuits, FIG. 8). As a result a five bit binary signal signifying that car "a" is located at the second landing is applied along lines BO(a), B1(a) --- B4(a) to the input terminals I1 of switching means SW1, SW2 --- SW5 respectively until the advancer brush FPU(a) makes contact with floor position contact FPC3(a) (not shown).

The circuitry associated with cars b, c and d (not shown) operate in the same manner to apply three additional five bit binary signals along lines BO(b) to B4(b), BO(c) to B4(c) and BO(d) to B4(d) to the input terminals I3, I5 and I7 respectively of the five switching circuits SW1, SW2 --- SW5.

During this time inverting amplifier IA57 (FIG. 5) as will be shown hereinafter applies a binary one level signal along line $\overline{CTS}$ to one input terminal of gate NA33 (FIG. 3). NAND gate NA33 combines the binary one level signal on line $\overline{CTS}$ and a 100KC pulsed signal applied to it along line $\overline{CK}$ from pulse generator CPG to apply a 100KC pulsed signal along line SS to the count up input pin 5 of binary counter BC7(FIG. 4). At this time it is assumed that there is no registered auxiliary hall call and as a result a binary one level signal is applied to each of the input pins of data selectors DS1 and DS2 (FIG. 3) as will be shown hereinafter. As a result a binary zero level signal is applied from the output pin 10 of one or the other of data selectors DS1 and DS2 to AND gate AN2 to cause it to apply a binary zero level signal along line CLR. The complement of the signal on line CLR is applied to the clear input pin 14 of binary counter BC7 to maintain the output signals from counter BC7 at a binary zero level although binary counter BC7 receives the pulses applies to it along line SS.

In order to show how the circuitry of this invention operates to produce a selection signal signifying that a car is the closest to a landing for which an auxiliary hall call signal is registered it will be assumed that a prospective passenger actuates the auxiliary hall call button S6 (FIG. 1). As a result the auxiliary hall call memory circuit SH6 (FIG. 1) applies a binary one level signal along line SH6 to one input terminal I3 of the auxiliary hall call circuit SHC6(a) (FIG. 6) and to one input terminal of NAND gate NA11 (FIG. 2). NAND gate NA11 combines the binary one level signals on lines $\overline{RSH6}$ (as will be understood hereinafter) and on line SH6 to apply a binary zero level signal along line $\overline{SHA6}$ to input pin 2 of data selector DS1 (FIG. 3).

At this time, as will also be understood hereinafter, monostable multivibrator MM1 (FIG. 3) applies a binary one level signal to one input terminal of NAND gate NA31 which also receives the 100KC pulsed signal from free running clock pulse generator CPG. As a result NAND gate NA31 applies a series of pulses to the count up input terminal 5 of binary counter BC1. Each pulse causes the pair of binary counters BC1 and BC2 to add an increment to their previous count applied along lines A, B, C, D and S. Lines A, B, C and D are respectively connected to the data select input pins 15, 14, 13 and 11 of the pair of data selectors DS1 and DS2 to cause each data selector to scan each of its 16 data input pins and to sequentially apply the complement of the signals applied to the input pins to output pins 10 when a binary zero level signal is applied to their respective strobe input pins 9. The signal on line S is applied to the strobe input pin 9 of data selector DS1 and its complement is applied to the strobe input pin of data selector DS2 in order to scan the signals applied to the pair of data selectors.

When the pair of binary counters BC1 and BC2 operating in response to a pulsed signal from gate NA31 apply a signal to the data selector DS1 which causes it to apply the complement of the signal line $\overline{SHA6}$ to its output pin 10, this signal and the binary one level signal from data selector DS2 cause AND gate AN2 to apply a binary one level signal along line CLR to the input of AND gate AN14. It is understood that monostable multivibrator MM2 operating in response to each pulsed signal applied to its input 12 from NAND gate NA31 applies a binary zero level pulsed signal to AND gate AN14. When the signal from pin 9 of multivibrator MM2 is restored to a binary one level, it is combined with the binary one level signal on line CLR by AND gate AN14 and applied to the input pin 4 of monostable multivibrator MM1 to cause it to apply a binary zero level pulsed signal of a sufficient pulse width to prevent NAND gate NA31 from producing any additional pulses for approximately 250 Ms. As a result the signal applied along lines A, B, C, D and S is maintained for a period of approximately 250 Ms. and because it is used to select the signal representing the registered auxiliary hall call for the sixth landing it may be also used to represent the sixth landing.

The signal on lines A, B, C, D and S used to represent the sixth landing are combined by AND gates AN4 --- AN12 with the binary one level signal on line CLR to apply a five bit binary signal representing the sixth landing along lines X0, X1, X2, X3 and X4. Simultaneously the binary zero level pulsed signal from monostable multivibrator is applied along line LD to binary counters BC3, BC4, BC5, BC6 to cause them to apply signals along lines UHA0, UHA1 --- UHA8 and DHA0, DHA1 --- DHA8 which correspond to the five bit binary signal applied along lines X0, X1 --- X4 representing the sixth landing. These signals are inverted and applied as two separate five bit binary signals to comparators COMP1 and COMP2 (FIG. 5).

The binary one level signal on line CLR is also inverted and applied to the clear input pin 14 of binary counter BC7 (FIG. 4) to enable it to operate in response to the pulses applied to it along line SS from NAND gate NA33 (FIG. 3). As a result, counter BC7 sequentially applies a four bit binary signal representing the decimal numbers 0–15 from its output terminals 3, 2, 6 and 7 to the input terminals 15, 14, 1 and 2 of decoder D1. In response to these signals, decoder D1 sequentially applies a binary zero level signal along lines $\overline{a}$, $\overline{b}$, $\overline{c}$, $\overline{d}$ and $\overline{S6}$. The binary zero level signals on lines $\overline{a}$, $\overline{b}$, $\overline{c}$ and $\overline{d}$ are inverted and are respectively applied to the input terminals I2, I4, I6 and I8 of the five switching circuits SW1, SW2 ... SW5 (FIG. 4) and to one input terminal of NAND gates NA45, NA47, NA49 and NA51. In response to signals on lines $\overline{a}$, $\overline{b}$, $\overline{c}$ and $\overline{d}$ switches SW1, SW2 ... SW5 sequentially apply signals signifying the car position of each car that is available (as will be understood hereinafter) to be selected to operate in response to the registered auxiliary hall call along lines C0, C1 ... C5 to the input terminals 13, 12, 11, 10 and 9 respectively of comparators COMP1 and COMP2 (FIG. 5). In addition, the signals on lines C0, C1 ... C5 are inverted and connected in common to apply a binary zero signal to enable the comparators COMP1 and COMP2 compare the two sets of signals when at least one car is available to be operated in response to the registered hall call.

The four signals on lines a, b, c and d are separately applied to the four input terminals of NAND gate NA39 (FIG. 4) which applies a binary one level signal to one input terminal of NAND gates NA41 and NA43 (FIG. 5) whenever switches SW1, SW2 . . . SW5 are enabled to transmit the aforementioned car position signals. At this time, it should be remembered that as assumed the car position signals applied to the pair of comparators signify that car "a" is located at the second landing, "b" at the twelfth, "c" at the top and "d" at the eleventh while the second set of signals applied to the comparators signify that the sixth landing is the landing for which a second hall call is registered. As a result comparators COMP1 and COMP2 both apply binary zero signals to the input terminals of NAND gates NA41 and NA43 respectively thereby causing a binary one signal to be applied along line $\overline{CTS}$ as previously assumed indicating that the two sets of signals including the car position signals of each car and landing signals signifying the sixth landing are not equal.

Subsequently, in response to the sequence of signals applied to it, decoder D1 (FIG. 4) applies a binary zero level pulsed signal along line $\overline{SC}$ to one input terminal of both gates NA35 and NA36. NAND gate NA35 applies a pulsed signal in response thereto to count up input terminal 5 of binary counter BC3 causing the counters BC3 and BC4 to apply a binary signal representing the seventh landing along lines UHA0, UHA1 . . . UHA8 to comparator COMP1. Simultaneously NAND gate NA37 applies a pulsed signal to the count down input terminal of counter BC5 causing counters BC5 and BC6 to apply a binary signal representing the fifth landing along lines DHA0, DHA1 . . . DHA8 to comparator COMP2.

It will be assumed that the above cycle is repeated three additional times and as a result the signals on lines UHA0, UHA1 . . . UHA8 represent the tenth landing and the signals on lines DHA0, DHA1 . . . DHA8 represent the second landing. Subsequently, in response additional pulses being applied along line $\overline{SS}$ to the count up input terminal 5 of counter BC7 (FIG. 4) a binary zero level signal is applied along line $\bar{a}$ to the input of amplifier IA39 and to NAND gate NA39, the latter causing a binary one level signal to be applied to the one of the the input terminals of both NAND gates NA41 and NA43 (FIG. 5).

Amplifier IA39 applies a binary one level signal to the input terminals I2 of the switching circuits SW1, SW2 . . . SW5 to enable them to apply the five bit binary signal representing the position of car "a" as being at the second landing along lines C0, C1 . . . C5 to the second set of input terminals of both comparators COMP1 and COMP2. Simultaneously, amplifier IA39 applies a binary one signal to one input terminal of NAND gate NA45 for later use. The binary signals representing the position of car "a" applied along lines C0, C1 . . . C5 are also applied to inverters IA47 to IA55 to produce a binary zero level signal along line NCA which is applied to the enable input pins 1 of comparators COMP1 and COMP2 to enable the comparators to compare the two sets of signals applied to them. As a result of the coincidence of the signals applied to it comparator COMP2 applies a binary one level signal to the second input of NAND gate NA43 causing a binary one level signal to be applied along line CTS and a binary zero level signal along line $\overline{CTS}$, the latter signal being applied to gate NA33 (FIG. 3) to prevent additional pulses from being applied along line SS to counter BC7 (FIG. 4). The binary one level signal on line CTS is combined with the complement of the signal on line $\bar{a}$ by NAND gate NA45 (FIG. 4) to produce a binary zero level signal which is applied along line $\overline{SE}$(a) to signify car "a" as the closest of the four cars to the sixth landing or the landing for which the auxiliary call is registered.

The binary zero level signal on line $\overline{SE}$(a) is inverted and applied to inverting delay circuit DL2 (FIG. 7) and to the input terminals I1 of five hall call landing memory circuits (MEM1(a), MEM2(a) . . . MEM5(a). In addition, a five bit binary signal representing the sixth landing is applied to the second input terminals I2 of the five memory circuits along lines X0, X1 . . . X5. As a result, these circuits apply a five bit binary signal representing the sixth landing along lines Y0(a), Y1(a) . . . Y4(a) to the input terminals 23, 22, 21, 20 and 19 of decoder D3.

Subsequently, delay circuit DL2 applies a binary zero level signal along line $\overline{SEX}$(a) to inverter IA81 (FIG. 9). In response thereto NAND gate NA81 applies a binary zero level signal along line $\overline{SES}$(a) signifying car "a" as selected to travel to and to stop at the sixth landing in response to the registered sixth landing hall call.

The binary zero level signal on line $\overline{SES}$(a) is inverted and applied to the input terminals I3 of the five memory circuits MEM1(a), MEM2 (a) . . . MEM5(a) shown in FIG. 7 to cause them to continue to apply the binary signal representing the sixth landing along lines YO(a), Y1(a) . . . Y4(a) to decoder D3. In addition the binary zero level signal on line $\overline{SES}$(a) is applied to the enable pin 18 of decoder D3 to cause it to apply a binary zero level signal along lines $\overline{MSH6}$(a) to input terminal I1 of auxiliary hall call circuit SHC6(a) shown in FIG. 6.

Simultaneously, the signal on line $\overline{SES}$(a) (FIG. 7) causes a binary zero level signal to be applied along lines UZR(a), $\overline{VHS}$(a), $\overline{VPH}$(a), $\overline{VHL}$(a) and VC1G to the control system which operates the cars in response to the primary hall calls to prevent the control system from operating car "a" in response thereto. In addition, the binary zero level signal on line $\overline{SES}$(a) also causes a binary zero level signal to be applied along line VRCB(a) to the car call circuitry associated with car "a" (FIG. 12) to cancel any registered car calls.

The binary zero level signal on line $\overline{MSH6}$(a) described above as being applied to the input terminal I1 of the auxiliary hall call circuit SCH6(FIG. 6) causes it to apply a binary zero level signal along lines $\overline{RSH6}$(a) to one input terminal of NAND gate NA11 (FIG. 2). As a result NAND gate NA11 applies a binary one level signal along line $\overline{SHA6}$ to input pin 2 of data selector DS1 causing it to apply a binary zero level signal to AND gate AN2. AND gate AN2, as a result applies a binary zero signal along line CLR to gates AN4 to AN14 and to inverter IA17 causing binary counters BC3-BC6 (FIG. 3) and BC7 (FIG. 4) to apply binary zero level signals from each of their output pins.

At the same time, the binary zero level signal on line $\overline{MSH6}$(a) causes a binary zero signal to be applied along line VCC6(a) to car call memory circuit CM6(a) (FIG. 12). As a result a binary one level signal is applied along line CC6 to the control equipment to produce an effective car call signal for the sixth landing.

As explained previously, binary zero level signals are applied along lines UZR(a), $V\overline{HS}$(a), $V\overline{PH}$(a), $V\overline{HL}$(a) and VC1G(a) to the control system to prevent it from operating car "a" in response to registered primary hall calls. In order to understand how this is accomplished it will be assumed that these signals are applied to the control system of Lusti et al previously cited.

The binary zero level signal applied along line $V\overline{HL}$(a) is applied to the expander node of a four input NAND gate shown in FIG. 3 of U.S. Pat. No. 3,703,222 to prevent the production of a binary one and zero signals along lines HL and $\overline{HL}$ respectively. The binary zero level signal applied along line $V\overline{PH}$ is applied to the expander node of a four input NAND gate shown in FIG. 2 of U.S. Pat. No. 3,703,222 to cause a binary zero level signal to be applied along line PH. As stated in the Lusti Patent the higher and lower call circuits for a simplex selective collective elevator includes conductor paths designated PH(I) connected through associated circuit terminals to conductor path PH. For a "group car" the same conductor path PH is connected through additional curcuitry the output of which is connected to conductor paths PZH(G). The operation of both of these sets of paths is identical and for the purpose of brevity it is to be understood that a binary zero level signal applied along conductor path PH causes a binary zero level signal to be applied along the sets of conductor paths PH(I) or PZH(G) shown in FIG. 1 of Lusti et al. As a result of the binary zero level signals applied along lines PH(I) and PZH(G) the location of the car at the second landing causes a binary one and zero level signals to be applied along conductor paths CP2 and $\overline{CP2}$ respectively and the effective car call signal for the sixth landing causes a binary one level signal to be applied to similar additional circuitry (not shown) to that shown in the lower portion of FIG. 1 of Lusti et al. It is understood that this circuitry applies binary zero and one level signals along conductor paths VHC and $\overline{LC1}$ respectively. The binary zero and one level signals are applied along lines VHC and $\overline{LC1}$ respectively to the circuitry shown in FIG. 3 of Lusti et al.

In response to the binary zero and one level signals applied along lines VHC and $\overline{LC1}$ respectively the circuitry shown in the upper portion of FIG. 3 of Lusti et al applies binary one and zero level signals along lines HD and LD respectively and the complements of these signals along lines $\overline{HD}$ and $\overline{LD}$. Consequently it is understood from the assumed condition that car "a" is at the second landing and traveling in an up direction and from the above explanation that binary one and zero level signals are applied along lines AU and AD shown in FIG. 3 of Lusti et al. The binary one level signals applied along conductor paths AU and HD cause a binary one level signal to be applied along conductor path FD shown in FIG. 3 also. This binary one level signal applied along line FD, as explained in Lusti et al, signifies that car "a" is to continue in its present direction of travel which will cause it to arrive at the sixth landing.

As noted above applicants' circuitry applies a binary zero level signal along line $V\overline{HS}$ to the control system. This signal is applied to conductive path $V\overline{HS}$ shown in FIG. 3 of Lusti et al and as will be understood hereinafter causes a binary zero signal to be applied along conductive path HS. In addition for the present it will be assumed that a binary one level signal is applied along conductive path $\overline{DT}$ (FIG. 3 of Lusti et al). Furthermore because the registered car calls associated with car "a"have been reset it is understood that a binary one level signal is applied along conductive path VPTS from the circuitry shown in FIG. 1 of Lusti. As a result a binary zero level signal is applied along conductive path PTS by the circuitry shown in FIG. 3 of Lusti et al.

The binary one level signals applied along conductor paths FD and PTS along with the binary one level signal applied along conductor path GO maintains the self-holding circuit of the circuitry associated with the conductor path GO. As a result a binary one level signal is applied along conductor path GO. The complements of the binary one level signals applied along conductor paths GO and AU are applied along conductor paths $\overline{GO}$(a) and $\overline{AU}$(a) by the control system to the control equipment shown in FIG. 13 of applicants' drawing which causes car "a" to travel in the upward direction toward the sixth landing.

When car "a" is located at a predetermined distance from the sixth landing the advancer selector brush FPU(a) (FIG. 13) engages floor position contact FPC6 thereby applying a voltage V1(a) along line CP6(a) to inverting level converter ILC6(FIG. 8). As a result a binary zero level signal is applied along line $\overline{CP6}$(a) to the input terminal I5 of second hall call circuit SHC6(FIG. 6) causing a binary zero level signal to be applied from output terminal 04 along line $\overline{PCAL}$(a) to the expander node of four input NAND gate NA72 (FIG. 9). The binary zero level signal on $\overline{PCAL}$(a) and a binary one level signal applied along conductive path PRR(a) from the control system as disclosed in Lusti are combined by circuitry shown in FIG. 9 to cause a binary zero level signal to be applied along conductive path VPTS(a). It is to be understood that this conductor is connected to the conductive path VPTS shown in FIG. 3 of Lusti et al. The binary zero level signal applied to conductive path VPTS of Lusti et al causes the circuitry shown in FIG. 3 of this patent to apply a binary one level signal along conductive path PTS.

The binary one level signal applied along conductive path PTS is applied to the self-holding circuitry described above which maintained the signal applied along line GO at a binary one level to cause this circuitry to apply a binary zero level signal along conductive path GO. As a result the control system applies a signal of voltage V1(a) along line $\overline{GO}$ to the control equipment shown in FIG. 13 of applicants' drawing. The voltage V1(a) on line $\overline{GO}$ is applied to the coil of switch ST (FIG. 13) to cause its switch contacts to be restored to their unoperated position. The release of the stopping switch associated with car "a" causes it to stop in a desired manner at the sixth landing in response to the consequent release of switches FE(a), E2(a), E1(a), H(a) and U(a).

Subsequently the car stops as the sixth landing and as a result the control equipment applies a binary zero signal along line ADV causing a binary one level signal to be applied along line $\overline{PRR}$ shown in FIG. 2 of U.S. Pat. No. 3,703,222. The binary one level signals on lines $\overline{PRR}$ and PTS cause a binary zero signal to be applied along line DT (FIG. 2) to the door open switch. As a result a binary zero level voltage is applied along line $\overline{DO}$(a) to one side of the door open relay DO(a) (FIG. 13). When the doors of car "a" reach the fully opened position a switch OL(a) (FIG. 13) is actuated to its opened position and as a result a binary zero level signal is applied to inverting amplifier IA96 (FIG. 9). This signal causes a binary zero signal to be applied along line $\overline{ACAL}$(a) (FIG. 9) which is inverted and applied along line SHR(a) to the input terminal I4 of second hall call circuit SHC6 (FIG.6). As a result a binary zero level signal is applied to line SH6 by a nand gate similarly arranged as nand gate NA69 shown in FIG. 6 to cause the cancellation of the auxiliary hall call for the sixth landing. The binary zero signal on line SH6 causes a binary one level signal to be applied along line VCC6(a) to the car call curcuitry (FIG. 12) and as a result a binary zero level signal is applied along line CC6 (FIG. 12).

The prospective passenger who registered the auxiliary hall call for the sixth landing enters the car and operates a switch on the car operating panel to operate car "a". Typically an independent service switch is provided for this type of service. As a result of the switch operation a binary zero level signal is applied along line $\overline{IND}$(a) to one input pin of NAND gate NA93 (FIG. 9) from the control system. The binary zero signal on line $\overline{IND}$(a) causes inverting amplifier IA93 to apply a binary one level signal along line $\overline{AES}$(a) (FIG. 9) to the circuitry shown in FIG. 8 to prevent car "a" from being selected to operate in response to any other auxiliary hall calls.

If for some reason the prospective passenger does not enter car "a" after its arrival at the sixth landing and does not operate the independent service switch within a predetermined time after the car doors are fully opened the car is restored to the group supervised operation after the predetermined time has elapsed. In order to understand how the circuitry of this invention operates to restore car "a" to group supervised operation after a predetermined time has elapsed subsequent to the opening of its door it will be assumed that car "a" travels to the sixth landing as described above. As a result the control system applies a binary one level signal along line RUN(a) to inverter IAS106 (FIG. 9) signifying that car "a" is moving. As a result a binary zero level signal is applied to time delay circuit TD1 which applies a binary one level signal to one terminal of gate NA115 (FIG. 9). During this time in response to the registered auxiliary hall call the circuitry shown in FIG. 6 applies a binary one level signal along line EHC to inverter IA101 (FIG. 9). As a result a binary one level signal is applied to the second input terminal of NAND gate NA115 causing a binary one level signal to be applied along line $\overline{NAES}$(a) as previously assumed. When car "a" stops at the landing the control system applies a binary zero level signal along line RUN(a) signifying that car "a" is stopped which is inverted and applied to one input terminal of NAND gate NA109 for later use. Subsequently the control system applies a binary zero level signal along line $\overline{DFO}$(a) signifying that the doors of car "a"are fully opened. This signal causes a binary zero level signal to be applied along line $\overline{ACAL}$(a) to the second input of NAND gate NA117. As a result a binary one level signal is applied to time delay circuit TD1. In response to the application of a binary one level signal to its input terminal the time delay operates to apply a binary one level signal to one input terminal of NAND gate NA115 for a predetermined period of time chosen herein as approximately 35 seconds and a binary zero signal thereafter. As a result if the prospective passenger does not operate car "a" to cause the control system to apply a binary one signal along line RUN(a) within the 35 second delay time the time delay circuit will apply a binary zero signal to NAND gate NA115. When this occurs a binary zero signal is applied along line $\overline{NAES}$(a) to cause inverter IA93 to apply a binary zero level signal to NAND gate NA99. As a result a binary one level signal is applied along line $\overline{SES}$(a) signifiying that car "a"is no longer selected. The binary zero level signal on line AES(a) is also applied to one input terminal of NAND gate NA107 (FIG.9) to cause a binary one level signal to be applied along line $\overline{ACAL}$(a). The binary one level signals on lines $\overline{ACAL}$(a) and $\overline{SES}$(a) are applied to NAND gate NA83 (FIG. 7) to cause binary one level signals to be applied along lines UZR(a), $\overline{VHS}$(a), $\overline{VPH}$(a), $\overline{VHL}$(a) and VC1G(a) to the control system and along line VRCB(a) to the car call registration means. As a result the control system resumes control of car "a" and restores it to the group supervised operation.

It was assumed that car "a" was signified as being located at the second landing and traveling in the up direction when it was selected to travel to and to stop at the sixth landing in response to the auxiliary hall call registered for the sixth landing. It should be understood that if car "a" was assumed to be traveling in the down direction the car selections means operates in the same manner as described above to select car "a" as the car signified closest to the sixth landing and applies a binary zero level signal along line SEX(a) to inverting amplifier IA81 (FIG. 9). In response to this signal a binary zero signal is applied along line $\overline{SES}$(a) (FIG. 9) to NAND gate NA83 (FIG. 7) to cause binary zero signals to be applied along lines UZR(a), $\overline{VHS}$(a), $\overline{VPH}$(a), $\overline{VHL}$(a) and $\overline{VC1G}$(a) to the control equipment and along line VRCB to the car call equipment associated with car "a".

In this case since car "a" is traveling in the down direction its direction of travel must be reversed in order for it to travel to the sixth landing. In order to accomplish this the binary zero signal on line $\overline{VPH}$ is applied to conductive path $\overline{VPH}$ shown in FIG. 2 of U.S. Pat. No. 3,703,222 and causes a binary zero signal to be applied along conductive path PH to the first hall call circuitry shown in FIG. 1 of U.S. Pat. No. 3,703,222. As a result of the car being located at the second landing and the effective car call signal for the sixth landing the circuitry similar to that shown in FIG. 1 of Lusti et al applies a binary one and zero signal along lines VHC and $\overline{LC1}$ respectively. These two signals causes a binary one and zero signal to be applied along lines HD and LD shown in FIG. 3 of that patent. However, since the car is traveling in the down direction as assumed binary zero and one signals being applied along lines AU and AD respectively signifying the direction of travel of car "a". As a result of the binary one signals on lines AD and HD and the binary zero level signals on lines AU and LD a binary zero level signal is applied along conductive path FD to the start switch circuitry shown in FIG. 3 of U.S. Pat. No. 3,703,222 to cause the start switch to apply a binary zero level signal along conductive path GO. As a result a voltage V1 is applied along line $\overline{GO}$ by the control system to the coil of the start relay GO which is released to its unoperated position causing car "a" to stop at the first landing it encounters. Subsequently in response to the binary zero level signal on line GO (FIG. 3 of Lusti et al) a binary one level signal is applied along line $\overline{DGO}$ which is combined with the binary one signal on line HD and the binary zero level signal on line LD to cause a binary one level signal to be applied on line AU and a binary zero level signal to be applied along line AD in order to cause the control equipment to operate car "a" in the up direction. In response to the binary one signals on lines AU and HD a binary one signal is applied along line FD to the start circuitry. This circuitry applies a binary one signal along line GO and causes a binary zero level signal to be applied to the start relay GO (FIG. 13) which causes the control equipment to move car "a" in the upward direction of travel in response to the second hall call signal. As a result car "a" travels to the sixth landing and stops thereat in the manner described above.

If as assumed above car "a" traveling in the down direction is signified as the car closest to the sixth landing and is caused to travel to the sixth landing, it is understood that in the time required for car "a" to stop at the first landing it encounters, reverse direction and start to travel in an up direction it is possible that car "d" assumed at the eleventh landing and traveling in the down direction could be signified as arriving at the sixth landing prior to the arrival of car "a". If this occurs a binary zero signal is applied along line $\overline{CP6}$(d) to input terminal 5 of the second hall call circuit SHC6(d) (not shown) but similar to circuitry shown in FIG. 6 for car "a". As a result a binary zero level signal is applied along line $\overline{PCAL}$(d) to the expander node of a four input NAND gate which forms part of the selection circuitry associated with car "d" which is similar to the circuitry to which line $\overline{PCAL}$(a) is connected as shown in FIG. 9 to cause a binary zero signal to be applied along line VPTS(d) to the passenger transfer stopping switch circuitry shown in FIG. 3 of U.S. Pat. No. 3,703,222. In response to this signal the control system shown in FIG. 3 applies a binary one level signal to the start switch circuitry causing binary zero and one level signals to be applied along conductive paths GO and $\overline{GO}$ respectively. In response to the signal on line $\overline{GO}$ the start switch GO associated with car "d" (not shown) but similar to that shown for car "a" on FIG. 13 is released and car "d"is stopped in a desired manner in response to the second hall call signal registered for the sixth landing. When the doors of car "d" are fully opened a binary zero signal is applied along conductive path $\overline{DFO}$(d) to the circuitry associated with car "d" and similar to the circuitry shown in FIG. 9 for car "a". As a result a binary zero level signal is applied along line $\overline{ACAL}$(d) (not shown) to circuitry similar to the circuitry shown in FIG. 7 to cause it to apply binary zero signals along lines UZR(d), V$\overline{HS}$(d), V$\overline{PH}$(d), V$\overline{HL}$(d) and V$\overline{C1G}$(d) to the control system and as a result car "d" is removed from the group supervised operation to enable the prospective passenger to enter it and actuate its independent operation switch.

In addition the binary zero level signal on line $\overline{ACAL}$(d) causes a binary one level signal to be applied to input terminal I4 of second hall call circuitry SHC6(d) similar to the circuitry SCH6(a) shown in FIG. 6. As a result a binary zero level signal is applied along line SH6 signifying the cancellation of the sixth landing second hall call signal.

However, it is understood that car "a" was selected to operate in response to the second hall call signal registered for the sixth landing and as such is prevented from operating in response to first hall call signals and its car call signals. In response to the binary zero level signal on line SH6 and a binary zero level signal on line MSH6(a) a binary zero level signal is applied along line EHC from the output terminal 02 of second hall call circuit SCH6(a). This binary zero level signal is applied along line EHC to inverter IA101 to cause a binary zero signal to be applied along line VPTS to the control system of Lusti et al. In response to the signal on line VPTS the control system causes car "a" to stop at the next landing it encounters in its direction of travel. After car "a" comes to a stop and subsequent to the opening of its doors a binary zero level signal is applied along line $\overline{NAES}$ to the input of gate NA93 (FIG. 9). As a result a binary zero level signal is applied along line AES(a) to gate NA81 (FIG. 9) causing a binary one level signal to be applied along line $\overline{SES}$(a) to the input of gate NA83 (FIG. 7) which causes binary one level signals to be applied along lines V$\overline{HS}$(a), V$\overline{PH}$(a), V$\overline{HL}$(a) and V$\overline{C1G}$(a) to the control equipment and along line VRCB(a) to the car call registration means associated with car "a" thereby enabling the control system to operate car "a" in its predetermined manner in response to registered primary hall calls and car calls.

If an auxiliary hall call is registered for the sixth landing and none of the cars operating in response to primary or car calls are selected to operate in response to the registered auxiliary hall call within a predetermined time it is understood that it is desirable to cause the first car which arrives at the sixth landing to stop thereat in response to the registered auxiliary hall call. In order to understand how this is accomplished, assume that one or more of the cars are operating in a predetermined manner in response to primary hall calls and their car calls. As a result the circuits associated with each car so operating individually operates in a manner similar to the circuitry shown in FIG. 9 for car "a" apply a binary zero level signal along lines $\overline{GPEC}$(a), $\overline{GPEC}$(b), $\overline{GPEC}$(c), or $\overline{GPEC}$(d). Each of the lines are connected to inverting amplifier IA13 (FIG. 2) which applies a binary one level signal to one input pin of NAND gate NA29. In response to the registered auxiliary hall call signal a binary zero level signal is applied along line $\overline{SHA6}$ which cause time delay circuit TD1 to apply a binary one level signal to inverter IA11. After the predetermined time has elapsed the time delay circuit TD1 applies a binary zero level signal to inverter IA11 causing NAND gate NA29 to apply a binary zero level signal along line $\overline{EWLD}$ to the circuitry associated with each of the cars and similar to the circuitry associated with car "a" shown in FIG. 6. Simultaneously as a result of the assumption that at least one or more of the cars are operating in response to the primary hall calls and their car calls a binary zero level signal is applied along their associated $\overline{ASE}$ lines by the circuitry associated with those cars and similar to that shown in FIG. 9 for car "a". As a result a binary zero level signal is applied to the input terminals I2 of the auxiliary hall call circuits associated with those associated cars causing a binary zero level signal to be applied along lines VCC6(a), VCC6(b), VCC6(c) or VCC6(d) to the car call circuitry associated with each car operating in the predetermined manner in response to the primary hall calls and car calls. Subsequently the first of the cars to arrive at the sixth landing in response to the binary one level signal on lines VCC6(a), VCC6(b), VCC6(c) or VCC6(d) signifying an effective sixth landing car call causes the cancellation of the registered auxiliary hall call for the sixth landing in a manner previously described. As a result of the cancellation of the registered auxiliary hall call a binary one level signal is applied along lines VCC6(a), VCC6(b), VCC6(c) and VCC6(d).

Although the operation of the present invention is disclosed in the interest of brevity for use with a particular control system, it is understood that the apparatus can be utilized with other well known control systems. It is also understood that various modifications of the invention will become apparent to those skilled in the art and that the arrangement described herein is for illustrative purposes and is not to be considered restrictive.

What is claimed is:

1. An improved elevator control system having a plurality of cars serving an upper, a lower and a plurality of intermediate landings of a building by stopping thereat and opening their doors, said elevator system including separate primary hall call registration means for registering primary hall calls for said landings, a separate set of car call registration means associated with each of said cars for registering car calls for said landings, car position signifying means individual to each car, each producing separate car position signals signifying the position of its associated car at said landings, control equipment operating in response to registered primary hall calls and car calls to cause said cars to operate in a predetermined manner, auxiliary hall call registration means separately associated with any one of a number of said landings, each operable to register an auxiliary hall call for its associated landing, and selection means operating in response to the registration of any auxiliary hall call when all of said cars are signified as being located at landings other than the landing for which said auxiliary hall call is registered to select a car for expedited service to said auxiliary hall call, wherein the improvement comprises:

said control equipment including means operative in response to the selection of a car which is traveling toward the landing for which said auxiliary hall call is registered for causing the selected car to travel non-stop to said landing and to stop thereat and open its doors, and said control equipment including means operative in response to the selection of a car which is traveling away from the landing for which said auxiliary hall call is registered to cause the selected car to stop in a prescribed manner, to reverse its direction of travel and thereafter to travel non-stop to said landing and to stop thereat and open its doors.

2. An improved elevator control system having a plurality of cars serving an upper, a lower and a plurality of intermediate landings of a building by stopping thereat and opening their doors, said elevator system including separate primary hall call registration means for registering primary hall calls for said landings, a separate set of car call registration means associated with each of said cars for registering car calls for said landings, car position signifying means individual to each car, each producing separate car position signals signifying the position of its associated car at said landings, control equipment operating in response to registered primary hall calls and car calls to cause said cars to operate in a predetermined manner, auxiliary hall call registration means separately associated with any one of a number of said landings, each operable to register an auxiliary hall call for its associated landing, and selection means operating in response to the registration of any auxiliary hall call when all of said cars are signified as being located at landings other than the landing for which said auxiliary hall call is registered to select a car for expedited service to said auxiliary hall call;

said selection means including car availability circuitry individual to each car, said car availability circuitry of said selected car operating in response to the opening of the doors of said selected car at the landing for which said auxiliary hall call is registered to release the selection of said car and to continue to prevent said control equipment from operating the associated car in said predetermined manner in response to primary hall calls and to prevent the registration of car calls for said associated car;

wherein the improvement comprises:

said selection means associated with each of the non-selected cars operating in response to said auxiliary hall call being in registration for a prescribed period to cause the car call registration means associated with said non-selected cars and with the landing for which said auxiliary hall call is registered to generate a request signal for said landing provided said associated car call registration means is not already registering a car call for said landing, whereby said control equipment operates to cause the first of said non-selected cars to arrive at the landing for which said auxiliary hall call is registered to stop thereat and open its doors provided said auxiliary hall call is still in registration.

3. A control system according to claim 2, wherein said selection means includes a landing scanner having a plurality of input terminals, a separate one for each auxiliary hall call registration means; said auxiliary hall call registration means generating auxiliary hall call signals in response to the registration of auxiliary hall calls and applying said signals to the associated inputs of said scanner; landing signal generating means generating repetitively and sequentially landing signals identifying the landings for which auxiliary hall calls can be registered, said landing signals being applied to said scanner and causing it to scan its corresponding input terminals; said scanner producing an output signal whenever an input terminal it is scanning has an auxiliary hall call signal applied to it; said landing signal generating means ceasing its sequential operation and continuing the generation of the landing signal it is generating in response to the production of an output signal from said scanner; a pair of counters; said landing signal generating means after ceasing its sequential operation applying the landing signals it is continuing to generate to said counters; said counters producing an output signal signifying the landing associated with the landing signal they are receiving; a comparator for each counter, each comparator receiving the output signal from its associated counter; car signal means generating repetitively and sequentially car signals identifying the cars in the system; switching means operating in response to said car signals and applying the associated car position signals to said comparators; each said comparators producing a coincidence signal when its two input signals correspond; incrementing means operating in response to each of said comparators failing to produce a coincidence signal after said switching means has applied all of said car position signals to each comparator, said incrementing means incrementing the output signals of said counters, one upwardly and one downwardly, so that the output signal of one counter signifies the landing above the landing associated with the landing signal it is receiving and the output signal of the other signifies the landing below; said incrementing means continuing such incrementing operations until said switching means operating in conjunction with said comparators causes one of said comparators to produce a coincidence signal; and selecting circuitry producing said selection signal in response to a coincidence signal from one of said comparators and to the car signal identifying the car whose position signal said one of said comparators is receiving when it produces said coincidence signal.

* * * * *